US009302747B2

(12) United States Patent
Lambrakos et al.

(10) Patent No.: US 9,302,747 B2
(45) Date of Patent: Apr. 5, 2016

(54) FLOATING OFFSHORE PLATFORM WITH PONTOON-COUPLED EXTENSION PLATES FOR REDUCED HEAVE MOTION

(71) Applicant: TECHNIP FRANCE, Courbevoie (FR)

(72) Inventors: Kostas F. Lambrakos, Houston, TX (US); Jang Whan Kim, Spring, TX (US); Johyun Kyoung, Katy, TX (US)

(73) Assignee: TECHNIP FRANCE, Courbevoie (FR)

( * ) Notice: Subject to any disclaimer, the term of this patent is extended or adjusted under 35 U.S.C. 154(b) by 301 days.

(21) Appl. No.: 13/922,361

(22) Filed: Jun. 20, 2013

(65) Prior Publication Data

US 2014/0305359 A1 Oct. 16, 2014

Related U.S. Application Data

(60) Provisional application No. 61/810,460, filed on Apr. 10, 2013.

(51) Int. Cl.
*B63B 39/06* (2006.01)
*B63B 1/10* (2006.01)
(Continued)

(52) U.S. Cl.
CPC ..... *B63B 35/44* (2013.01); *B63B 1/107* (2013.01); *B63B 39/06* (2013.01); *B63B 35/4413* (2013.01); *B63B 2001/044* (2013.01); *B63B 2001/128* (2013.01); *B63B 2039/067* (2013.01)

(58) Field of Classification Search
CPC .. B63B 1/107; B63B 2001/044; B63B 35/44; B63B 35/4413; B63B 2035/442; B63B 2035/443; B63B 2035/4473; B63B 2035/448; B63B 2035/4486; B63B 2035/4493; B63B 39/06; B63B 39/062; B63B 39/063; B63B 2039/067; B63B 2039/068; B63B 2001/128; B63B 2035/4433
USPC ..... 114/121, 126, 264, 265
See application file for complete search history.

(56) References Cited

U.S. PATENT DOCUMENTS 2,973,046 A * 2/1961 McLean ..... E02B 17/027 175/8
3,224,401 A * 12/1965 Kobus ..... B63B 35/4413 114/126

(Continued)

FOREIGN PATENT DOCUMENTS

GB 2339730 A * 2/2000 ..... B63B 35/44
JP S5781995 5/1982

(Continued)

OTHER PUBLICATIONS

Gardel, A., International Search Report for International Patent Application No. PCT/US2013/042755, dated Aug. 26, 2013, European Patent Office.

(Continued)

*Primary Examiner* — Ajay Vasudeva
(74) *Attorney, Agent, or Firm* — Jackson Walker L.L.P.

(57) ABSTRACT

A floating offshore platform is disclosed with one or more extension plates fixedly coupled to one or more pontoons on the offshore platform and extending from the pontoons. As the floating platform moves, the pontoon-coupled extension plates separate the water and cause drag on the platform. The water moving with the extension plates also increases the dynamic mass. The added drag and dynamic mass increases the natural period of the motion away from the wave excitation period to minimize the wave driven motion compared to a platform without the extension plates. The extension plates can be coupled to the pontoons during fabrication at the yard directly or through frame members. The extension plates generally are generally located inclusively between the top and bottom elevations of the pontoons, and therefore do not significantly reduce the clearance between the seabed and the hull at the quayside.

14 Claims, 16 Drawing Sheets

(51) Int. Cl.

| | |
|---|---|
| ***B63B 35/44*** | (2006.01) |
| *B63B 1/12* | (2006.01) |
| *B63B 1/04* | (2006.01) |

(56) References Cited

U.S. PATENT DOCUMENTS

| | | | | | |
|---|---|---|---|---|---|
| 3,673,974 | A | * | 7/1972 | Harper | B63B 35/4413 114/265 |
| 5,997,218 | A | * | 12/1999 | Børseth | 405/223.1 |
| 6,125,780 | A | * | 10/2000 | Sweetman et al. | 114/264 |
| 6,408,780 | B1 | * | 6/2002 | Ozaki et al. | 114/264 |
| 6,652,192 | B1 | | 11/2003 | Xu et al. | |
| 6,718,901 | B1 | | 4/2004 | Abbott et al. | |
| 7,156,040 | B2 | | 1/2007 | Merchant et al. | |
| 7,219,615 | B2 | | 5/2007 | Merchant et al. | |
| 8,418,640 | B2 | * | 4/2013 | Leverette | B63B 35/4413 114/122 |
| 8,967,068 | B2 | * | 3/2015 | Yang | B63B 35/44 114/122 |
| 2002/0041795 | A1 | | 4/2002 | Russell et al. | |
| 2004/0141812 | A1 | | 7/2004 | Busso | |
| 2008/0115714 | A1 | | 5/2008 | Tahar et al. | |
| 2009/0205554 | A1 | | 8/2009 | Srinivasan | |
| 2010/0024705 | A1 | | 2/2010 | Leverette | |
| 2012/0034034 | A1 | | 2/2012 | Xu | |

FOREIGN PATENT DOCUMENTS

| | | | | | |
|---|---|---|---|---|---|
| JP | S57134998 | | | 8/1982 | |
| JP | S6110693 | | | 5/1986 | |
| JP | S6181499 | | | 5/1986 | |
| JP | 62244789 | A | * | 10/1987 | B63B 35/34 |
| JP | S62292587 | | | 12/1987 | |
| JP | S6370498 | | | 5/1988 | |
| JP | 06329080 | A | * | 11/1994 | B63B 35/44 |
| JP | 08189282 | A | * | 7/1996 | E21B 43/00 |
| JP | 2000247291 | A | * | 9/2000 | B63B 35/44 |
| JP | 2003072680 | A | * | 3/2003 | B63B 39/10 |
| KR | 20100090991 | | | 8/2010 | |
| WO | 9210398 | | | 6/1992 | |

OTHER PUBLICATIONS

Gardel, A., Written Opinion for International Patent Application No. PCT/US2013/042755, dated Aug. 26, 2013, European Patent Office.

International Search Report for International Patent Application No. PCT/US2014/032565 dated Jul. 22, 2014.

Written Opinion for International Patent Application No. PCT/US2014/032565 dated Jul. 22, 2014.

* cited by examiner

FLOATING OFFSHORE PLATFORM WITH PONTOON-COUPLED EXTENSION PLATES FOR REDUCED HEAVE MOTION

CROSS REFERENCE TO RELATED APPLICATIONS

This application claims the benefit of U.S. Provisional Application No. 61/810,460, filed Apr. 10, 2013.

STATEMENT REGARDING FEDERALLY SPONSORED RESEARCH OR DEVELOPMENT

Not applicable.

REFERENCE TO APPENDIX

Not applicable.

BACKGROUND OF THE INVENTION

1. Field of the Invention

The disclosure relates a method and a system for reducing the vertical motions on floating platforms for drilling and production. More particularly, the present disclosure relates to floating platforms used in the exploration and production of offshore oil and gas, and more particularly to a semisubmersible floating platform having extension plates fixedly coupled to pontoons that collectively function to reduce heave motion of the platform.

2. Description of the Related Art

With the significantly increasing demand on the oil and gas supply, offshore exploration and production from reservoirs has become vital to such supply. These reservoirs usually require large drilling rigs and variable payloads which result in very large topsides in both size and weight. Large and expensive supporting offshore platforms are needed. However, the expense of such platforms can be decreased by building such a floating structure near or on shore and towing the structure to the intended offshore site.

Among the main types of offshore platforms designed for deep water, including the popular Spar, a type of platform is known as a semi-submersible platform. The structure is built near shore or onshore, floated to the offshore site, and partially submerged using ballast tanks to provide stability to the structure. Semi-submersibles are typically configured with large buoyant pontoon structures below the water surface and slender columns passing through the water surface supporting a topsides deck at a significant height above the water surface. Semi-submersible platforms make large and cost effective platforms for drilling and production of offshore oil and gas. However, because the structure has a relatively large floating surface, one challenge is restricting movement caused by wave and wind action to provide a desired stability for operations.

Heave plates have been used to stabilize movement of the semi-submersible platforms. The heave plate can be a solid plate, or a constructed assembly of a plurality of plates that form a box, to form a relatively large width compared to its thickness, as is generally understood by the term "plate". The heave plate is mounted to the semi-submersible platform below the water surface and below at least a portion of the wave-influenced water zones. The heave plate increases the hydrodynamic mass of the offshore platform, where hydrodynamic mass is a measure of the amount of a fluid moving with a body that accelerates in the fluid and depends on the shape of the body and the direction of its motion. The heave plate at the lower depths provides additional resistance to vertical and tilting motion that would otherwise occur near or at the water surface. Typically, designers are motivated to mount the heave plate at deeper levels. However, the depth is initially limited, because the platform is built near or on shore at shallow depths. Thus, some systems have a lowering capability to the heave plate. The heave plate can be lowered to a more desirable depth after the platform is in position at the intended offshore site. Examples of such systems are illustrated, for example, in U.S. Pat. No. 6,652,192, U.S. Pat. No. 7,219,615 (as a continuation of U.S. Pat. No. 7,156,040), and U.S. Pat. No. 6,718,901, and are incorporated by reference herein. Each of these systems discloses lowering the heave plate to a depth below the platform after being located to the intended offshore site.

U.S. Pat. No. 6,652,192 discloses a heave suppressed, floating offshore drilling and production platform having vertical columns, lateral trusses connecting adjacent columns, a deep-submerged horizontal plate supported from the bottom of the columns by vertical truss legs, and a topside deck supported by the columns. The lateral trusses connect adjacent columns near their lower end to enhance the structural integrity of the platform. During the launch of the platform and towing in relatively shallow water, the truss legs are stowed in shafts within each column, and the plate is carried just below the lower ends of the columns. After the platform has been floated to the deep water drilling and production site, the truss legs are lowered from the column shafts to lower the plate to a deep draft for reducing the effect of wave forces and to provide heave and vertical motion resistance to the platform. Water in the column shafts is then removed for buoyantly lifting the platform so that the deck is at the desired elevation above the water surface.

U.S. Pat. No. 7,219,615 discloses a semi-submersible vessel having a pair of vertically spaced pontoons with varied buoyancy. The lower pontoon is retained in a close vertical proximity to the upper pontoon when the vessel is in transit. The lower pontoon is ballasted at the deployment site, dropping the pontoon to a depth of about 32 meters below the first pontoon baseline. As a result, stability and motion characteristics of the vessel are significantly improved.

While each of these systems offer solutions for a stabilized platform having a lowered heave plate, in practice the supporting structure for the heave plate to the platform may suffer from rigidity challenges. For example, U.S. Pat. No. 7,219,615 discloses extendable legs. Due to the extendable nature of the legs, no diagonal bracing between legs is shown that would be able to resist twisting and bending of the extended support structure to the heave plate, because diagonal bracing between the legs would apparently interfere with extending and retracting the legs through the guides. U.S. Pat. No. 6,652,192 illustrates extendable trusses within columns having diagonal flexible cable bracing installed between trusses after extension of the legs. Due to an interference between the truss diagonal members and the column, it is hard to design a receptacle which can enclose the truss legs and rigid diagonal bracing for effective support and load transfer. The patent does not disclose rigid bracing between trusses for the same reason, namely, the rigid bracing between the trusses would appear to interfere with extending and retracting the trusses. Another example includes U.S. Pat. No. 6,718,901 that discloses extendable legs so that deploying an offshore oil and gas production platform comprises placing a buoyant equipment deck on a buoyant pontoon so that elongated legs on the pontoon, each comprising a buoyant float, extend movably through respective openings in the deck. Chains extending from winches on the deck are reeved through fairleads on the pontoon and connected back to the deck. The chains are tightened to secure the deck to the pontoon for conjoint movement to an offshore location. The chains are loosened and the pontoon and leg floats ballasted so that the pontoon and leg floats sink below the floating deck. A further example of the extending draft concept is seen in US Publ. No. 20020041795.

Further, a deep draft semisubmersible usually needs to have larger than a 60 m draft to have the favorable motion to support the connections to the sea floor in harsh sea states. With this deep draft semisubmersible, the topside integration at the quayside and the transition from the fabrication yard to the installation site become problematic, because the column is too high to stabilize the platform during the transition mode. Many designs solve this difficulty by extending the draft that requires the significant risk of offshore installation operation.

There remains a need for a different system and method for a floating offshore platform having an improved stabilization of the offshore platform.

BRIEF SUMMARY OF THE INVENTION

The disclosure provides improved performance and reduces horizontal and/or vertical movement of a floating offshore platform by including one or more extension plates coupled to one or more pontoons on the offshore platform and extending from the pontoons that allow water on either side of the extension plates to reduce heave motion of the platform. The extension plates will generally have a combined surface area extending from the pontoons of at least 10% of a surface area defined by an interior perimeter area of the pontoons without the extension plates. As the floating platform moves, the pontoon-coupled extension plates separate the water and cause drag on the platform in the direction of movement. Drag results in less movement of the platform without the need to extend legs of the platform to gain an equivalent reduction in movement. The water moving with the extension plates also increases the dynamic mass. In some embodiments, with at least two extension plates extending from the same surface of the pontoon at different locations so that one extension plate is disposed adjacent the other extension plate, the water is entrapped between the extension plates and further creates dynamic mass to the platform to reduce heave. The added dynamic mass increases the natural period of the motion away from the wave excitation period to minimize the wave driven motion. As a result, the motion of the platform can be reduced compared to a platform without the extension plates. The extension plates can be coupled to the pontoons during fabrication at the yard directly or through frame members. The extension plates generally are above or at the same level of the extension, and therefore would not significantly reduce the clearance between the seabed and the hull at the quayside.

The disclosure provides a floating offshore platform, comprising: a floating hull comprising: at least one vertically extending column; and at least one pontoon coupled to the vertically extending column that are configured to be disposed at least partially below a surface of water in which the offshore platform is disposed; and at least one extension plate that extends from and is fixedly coupled to the pontoon at an elevation that is at least partially below a surface of water in which the offshore platform is disposed during operation, and configured to reduce heave motion on the platform by at least causing horizontal water separation, vertical water separation, or a combination thereof around the pontoon-coupled extension plate as the platform moves in water.

DETAILED DESCRIPTION

Figure 1:
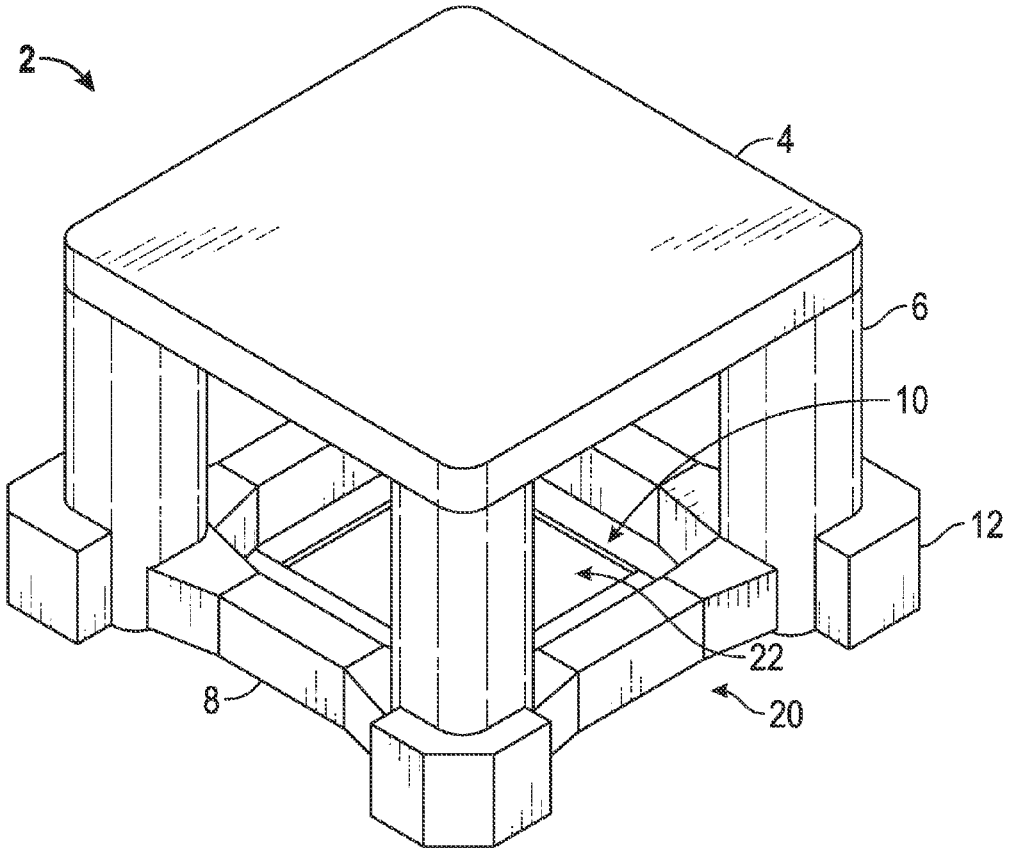
FIG. 1 is a schematic perspective view of an exemplary embodiment of a floating offshore platform having a extension plate.

The Figures described above and the written description of specific structures and functions below are not presented to limit the scope of what Applicant has invented or the scope of the appended claims. Rather, the Figures and written description are provided to teach any person skilled in the art how to make and use the inventions for which patent protection is sought. Those skilled in the art will appreciate that not all features of a commercial embodiment of the inventions are described or shown for the sake of clarity and understanding. Persons of skill in this art will also appreciate that the development of an actual commercial embodiment incorporating aspects of the present inventions will require numerous implementation-specific decisions to achieve the developer's ultimate goal for the commercial embodiment. Such implementation-specific decisions may include, and likely are not limited to, compliance with system-related, business-related, government-related and other constraints, which may vary by specific implementation, location, and from time to time. While a developer's efforts might be complex and time-consuming in an absolute sense, such efforts would be, nevertheless, a routine undertaking for those of ordinary skill in this art having benefit of this disclosure. It must be understood that the inventions disclosed and taught herein are susceptible to numerous and various modifications and alternative forms. The use of a singular term, such as, but not limited to, "a," is not intended as limiting of the number of items. Also, the use of relational terms, such as, but not limited to, "top," "bottom," "left," "right," "upper," "lower," "down," "up," "side," and the like are used in the written description for clarity in specific reference to the Figures and are not intended to limit the scope of the invention or the appended claims. Where appropriate, some elements have been labeled with an alphabetic character after a number to reference a specific member of the numbered element to aid in describing the structures in relation to the Figures, but is not limiting in the claims unless specifically stated. When referring generally to such members, the number without the letter is used. Further, such designations do not limit the number of members that can be used for that function.

A floating offshore platform is disclosed with one or more extension plates fixedly coupled to one or more pontoons on the offshore platform and extending from the pontoons. As the floating platform moves vertically, the pontoon-coupled extension plates separate the water and cause drag on the platform. The water moving vertically with the extension plates also increases the dynamic mass. The drag and dynamic mass increases the natural period of the vertical motion away from the wave excitation period to minimize the wave driven motion compared to a platform without the extension plates. The extension plates can be coupled to the pontoons during fabrication at the yard directly or through frame members. The extension plates generally are located inclusively between the top and bottom elevations of the pontoons, and therefore do not reduce the clearance between the seabed and the extension of the hull at the quayside.

Figure 2:
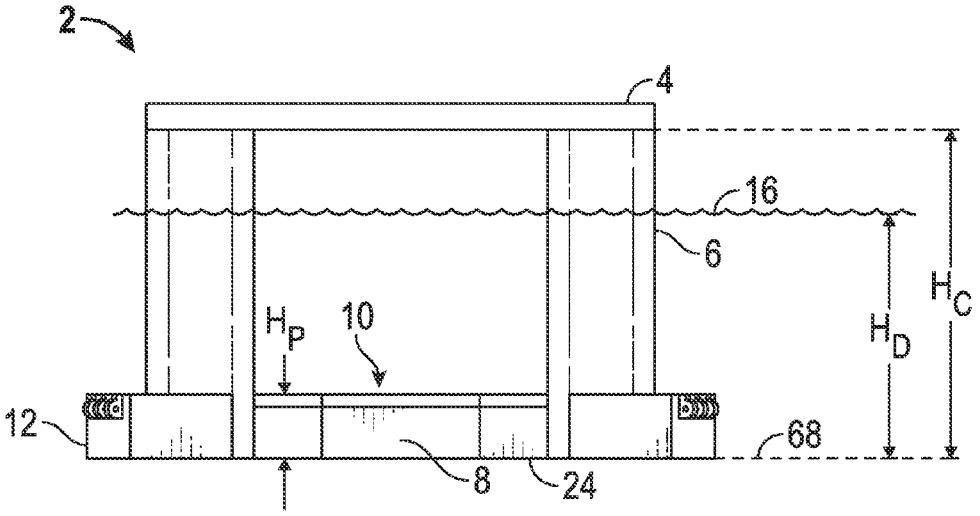
FIG. 2 is a schematic side view of the exemplary floating offshore platform with the extension plate.
Figure 3:
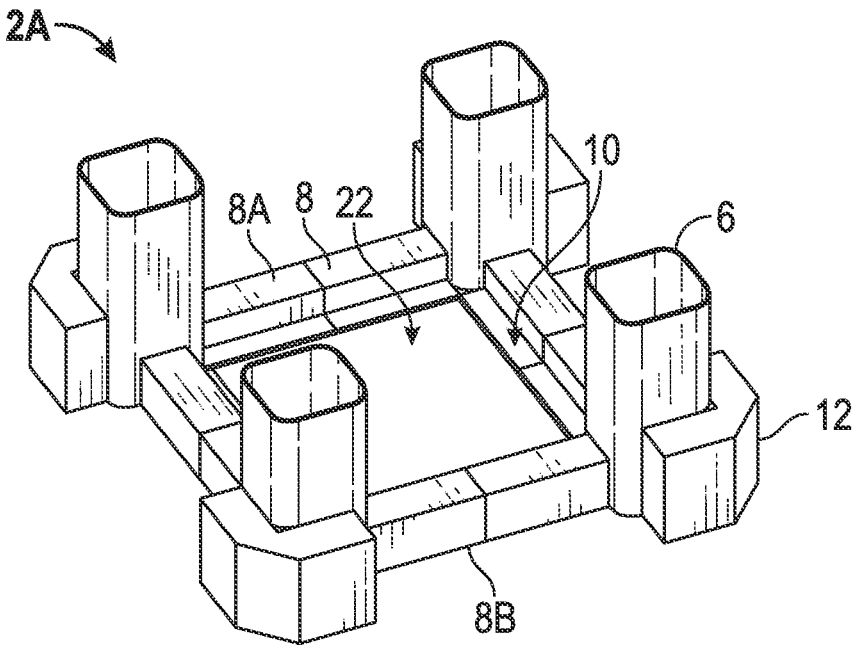
FIG. 3 is a schematic perspective view of another exemplary embodiment of a floating offshore platform having one or more extension plates fixedly coupled to a bottom portion of one or more pontoons.
Figure 4:
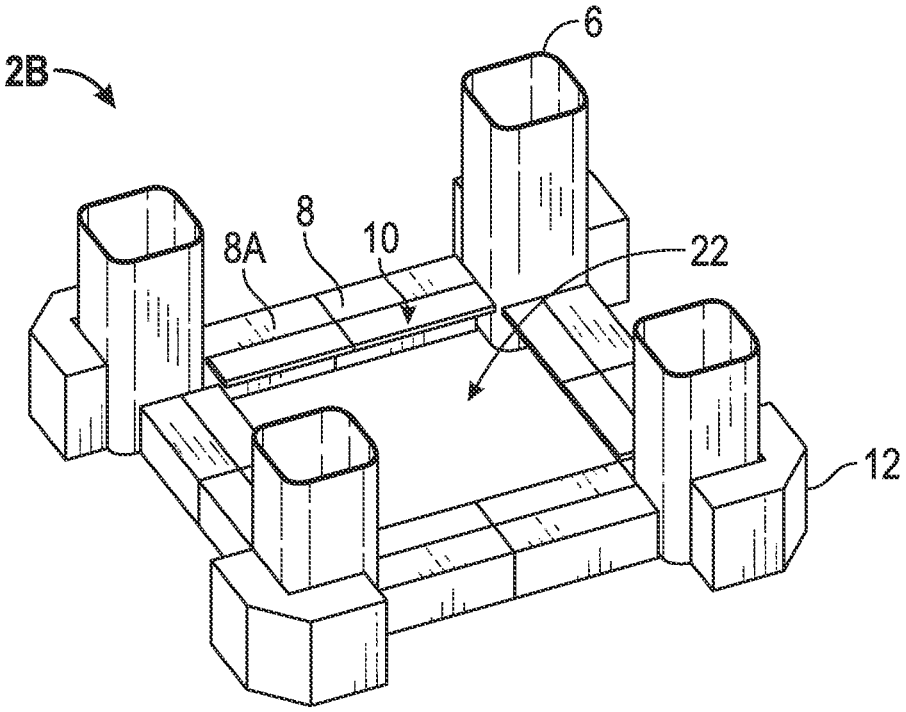
FIG. 4 is a schematic perspective view of another exemplary embodiment of a floating offshore platform having one or more extension plates fixedly coupled to a top portion of one or more pontoons.
Figure 5:
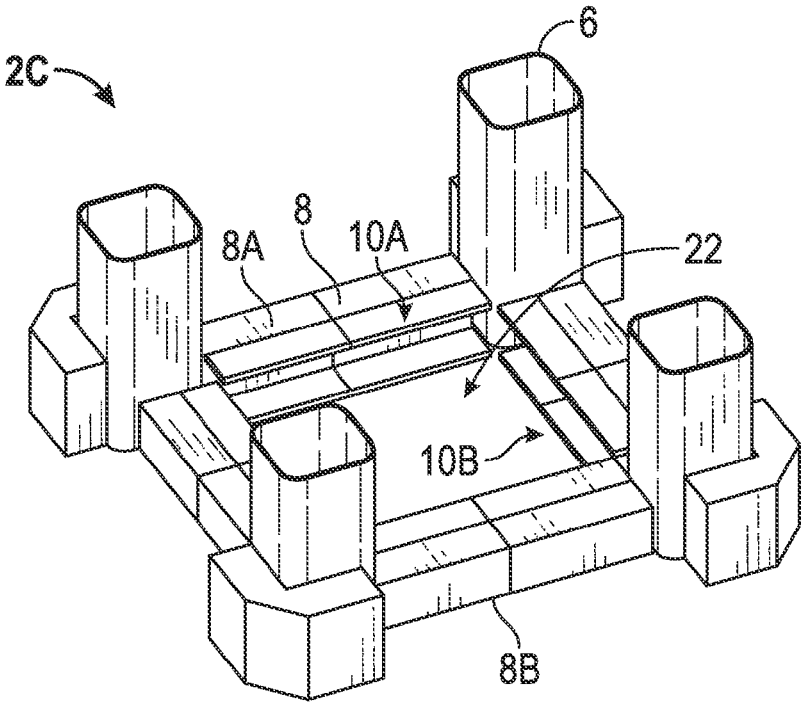
FIG. 5 is a schematic perspective view of another exemplary embodiment of a floating offshore platform having one or more extension plates fixedly coupled to a bottom portion and a top portion of one or more pontoons.

FIG. 1 is a schematic perspective view of an exemplary embodiment of a floating offshore platform having a extension plate. FIG. 2 is a schematic side view of the exemplary floating offshore platform with the extension plate. FIG. 3 is a schematic perspective cross sectional view of the floating offshore platform with the extension plate disposed in an open area between the pontoons, columns, or a combination thereof. FIG. 4 is a schematic top cross sectional view of the floating platform with the extension plate. FIG. 5 is a schematic side cross sectional view of the floating platform with the extension plate. The figures will be described in conjunction with each other.

An exemplary floating offshore platform 2 generally includes a topsides 4 (also referenced a deck) that supports equipment, facilities, and operations for the offshore platform. The topsides 4 is coupled to a plurality of columns 6, generally at least three and often four columns. The columns 6 have a column height $H_C$ with a portion that is below a water level 16 to establish a draft height $H_D$. The columns can be at least partially buoyant and can be adjustable in their buoyancy. The columns 6 can be coupled with pontoons 8, generally with two pontoons disposed at angles to each other and coupled to the same column (and indirectly coupled to each other). Alternatively, the pontoons can be directly coupled to each other to form a pontoon base and the columns coupled to the pontoon base. Generally, the pontoons 8 are designed to be disposed in operation in a substantially horizontal plane 68. In some embodiments, the column 6 can include a column base 12 that extends as an enlargement from one or more other portions of the column 6. The pontoons have a height $H_P$. The column base 12 can have a different height than the pontoons.

The columns 6 (with the column bases 12 if present) and pontoons 8 can be referenced herein as a hull 20. An inward hull opening 22 is formed between the pontoons of the pontoon base and any inward exposed portions of the columns coupled with the pontoons. having a surface area defined by an interior perimeter area of the pontoons without the extension plates. The hull opening 22 is generally used to position risers to the seafloor (not shown) and other subsurface members.

The disclosure provides one or more extension plates 10 that are coupled the pontoons. The extension plates can be coupled in any suitable manner as coupling is defined herein, including for example and without limitation, welding, bolting, and other fastening, and can include the use of a frame or other components to couple the extensions to the pontoons. An extension plate 10 is generally a plate as the term is normally used in the field, that is, having a large square area compared to a small thickness and is generally a non-buoyant structure. The extension plate 10 of this embodiment is generally oriented horizontally and located between the top and bottom elevations, inclusive, of the pontoons inside the hull opening 22 of the hull 20. The extension plate can have other geometric shapes as may be appropriate for the offshore platform, including without limitation, rectangular, triangular, and square, and so forth.

In at least one embodiment, the extension plate 10 is coupled at or above the bottom 24 of the hull 20 of the offshore platform 2, that is, the extension plate generally can be positioned at an elevation that is inclusively between the top and the bottom of a pontoon. The extension plate 10 can be installed during the fabrication process of the offshore platform at the fabrication yard. Thus, the extension plate and the frame do not necessarily decrease a bottom clearance during the wet tow or quayside integration of the topside 4.

The extension plate 10 in the illustrated embodiment helps add drag from the water volume moving across the extension plate during vertical movement of the platform. The water separation dissipates the energy to generate drag during the platform movement. The drag helps reduce the induced heave motion of the platform through the damping, such as in hurricanes in the Gulf of Mexico and other harsh sea states. The addition of the extension plate provides a better heave motion by increasing the natural period of a heave motion larger than a conventional deep draft semisubmersibles. In addition, the size of the extension plate or plates help tune the phase of the wave loads on the hull 20 to reduce the total wave loads at a critical heave period when the wave energy is maximum. The particular size and configurations can be modeled and/or experimentally determined by those with ordinary skill in the art, given the teachings and guidance provided herein. For example, too small of an extension plate reduces the surface area available for water separation and added mass, and can result in reduced effectively of the extension plate.

The sheets of drawings with FIGS. 3-6A illustrates various other exemplary embodiments of one or more extension plates coupled to one or more pontoons.

FIG. 3 is a schematic perspective view of another exemplary embodiment of a floating offshore platform having one or more extension plates fixedly coupled to a bottom portion of one or more pontoons. The offshore platform 2A shown in FIG. 3 includes the columns 6 and the pontoons 8, as has been described above. The one or more extension plates 10 are coupled to a bottom portion of the pontoons around an inner periphery of the pontoons and adjoining columns. The embodiment includes a single level of extension plates coupled to the bottom portion of the pontoons on the inward surfaces of the pontoons. Other embodiments described below couple the extension plate to a top portion of the pontoon and/or on the outward surfaces of the pontoon.

FIG. 4 is a schematic perspective view of another exemplary embodiment of a floating offshore platform having one or more extension plates fixedly coupled to a top portion of one or more pontoons. The offshore platform 2B of this embodiment is similar to the embodiment shown in FIG. 3, but with the one or more extension plates 10 coupled to a top portion of the one or more pontoons 8. The terms "bottom portion" and "top portion" are intended to be broadly construed such that the bottom portion is lower than halfway of the height $H_P$, shown in FIG. 2, of the pontoon, and the top portion is higher than the half height of the pontoon. The bottom portions and top portions can include the bottom and top surfaces of the pontoons as well.

FIG. 5 is a schematic perspective view of another exemplary embodiment of a floating offshore platform having one or more extension plates fixedly coupled to a bottom portion and a top portion of one or more pontoons. The offshore platform 2C of this embodiment illustrates one or more extension plates on both the top portion 8A and the bottom portion 8B. The use of multiple extension plates at different levels is described in more detail below.

Figure 6A:
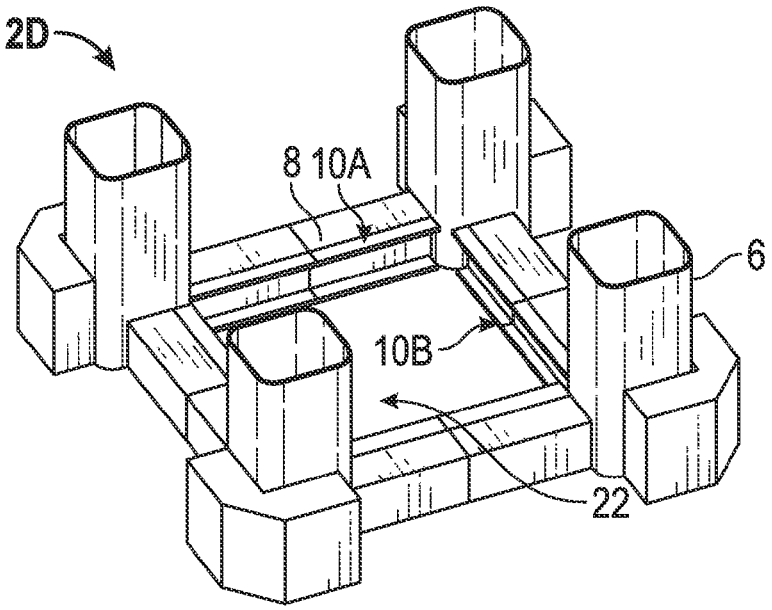
FIG. 6A is a schematic perspective view of another exemplary embodiment of a floating offshore platform having one or more extension plates fixedly coupled to a bottom portion and a top portion of one or more pontoons, the extension plates having a narrower width compared to a width of the extension plates in FIG. 5.

FIG. 6A is a schematic perspective view of another exemplary embodiment of a floating offshore platform having one or more extension plates fixedly coupled to a bottom portion and a top portion of one or more pontoons. The offshore platform 2D of this embodiment is similar to the embodiment shown in FIG. 5 with the one or more extension plates 10A, 10B being a narrower width than the extension plates illustrated in FIG. 5. For example, the combined surface area of the extension plates of the platform 2D from a top view could equal about 10% of the square area of the hull opening 22 between the pontoons without the extension plates. By comparison, the combined surface area of the extension plates of the platform 2C from a top view could equal about 35% of the square area of the hull opening 22 between the pontoons without the extension plates. Other percentages can be used from tuning the performance of the offshore platform for the particular environment in which the platform is designed and the percentages are exemplary. Generally, it is believed that most performance enhancements from the extension plates can be commercially achieved with a square area of the extension plates as viewed from a top view between 10% and 40% inclusively of the square area of the hull opening 22 as calculated without the extension plates, and any percentage therebetween such as 15%, 20%, 25%, 30%, and 35%, and 11%, 12%, 13%, 14%, and so forth.

Figure 6B:
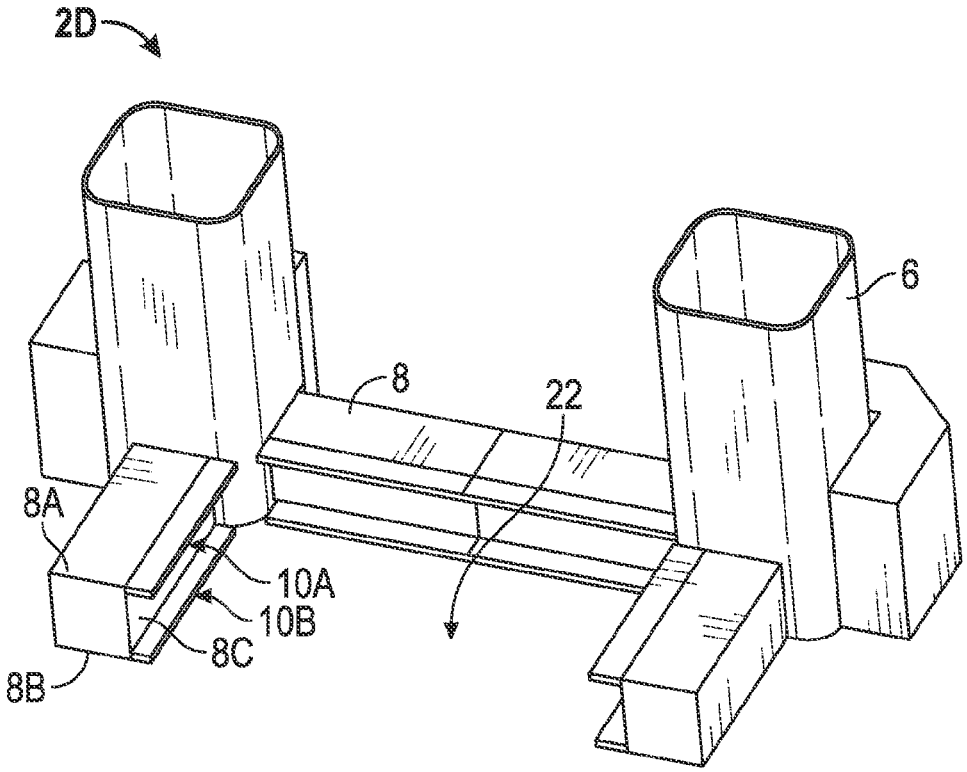
FIG. 6B is a cross sectional schematic perspective view of the embodiment of FIG. 6A.
Figure 6C:
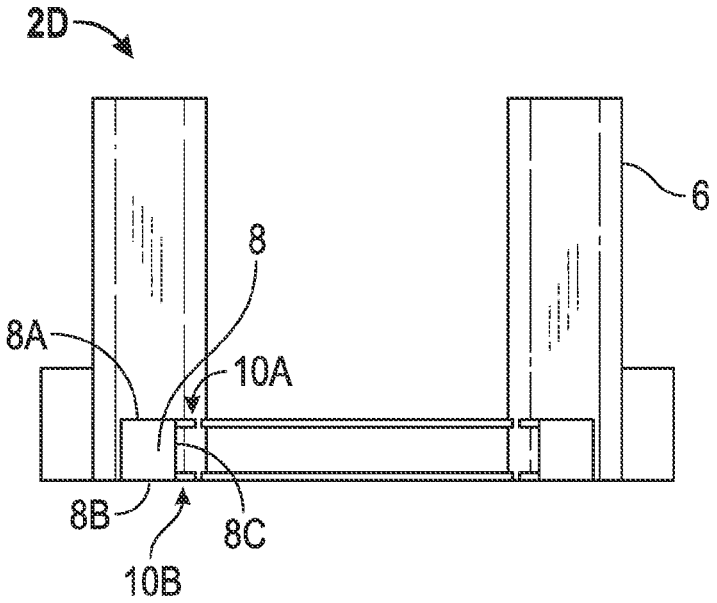
FIG. 6C is a cross sectional schematic side view of the embodiment of FIG. 6B.
Figure 6D:
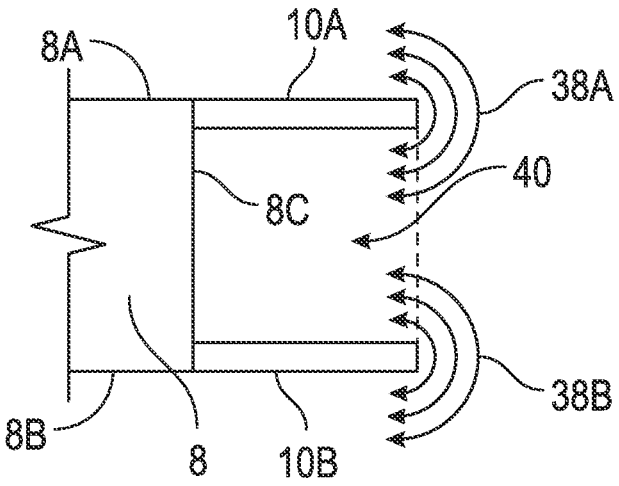
FIG. 6D is a detail cross sectional schematic view of extension plates coupled to a pontoon with water separation and water entrapment from FIG. 6C.
Figure 6E:
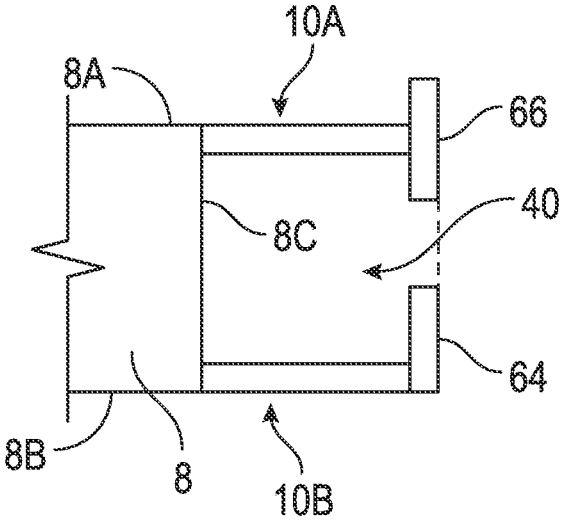
FIG. 6E is a detail cross sectional schematic view of extension plates with wings coupled to a pontoon with water separation and water entrapment similar to the embodiment in FIG. 6D.
Figure 6F:
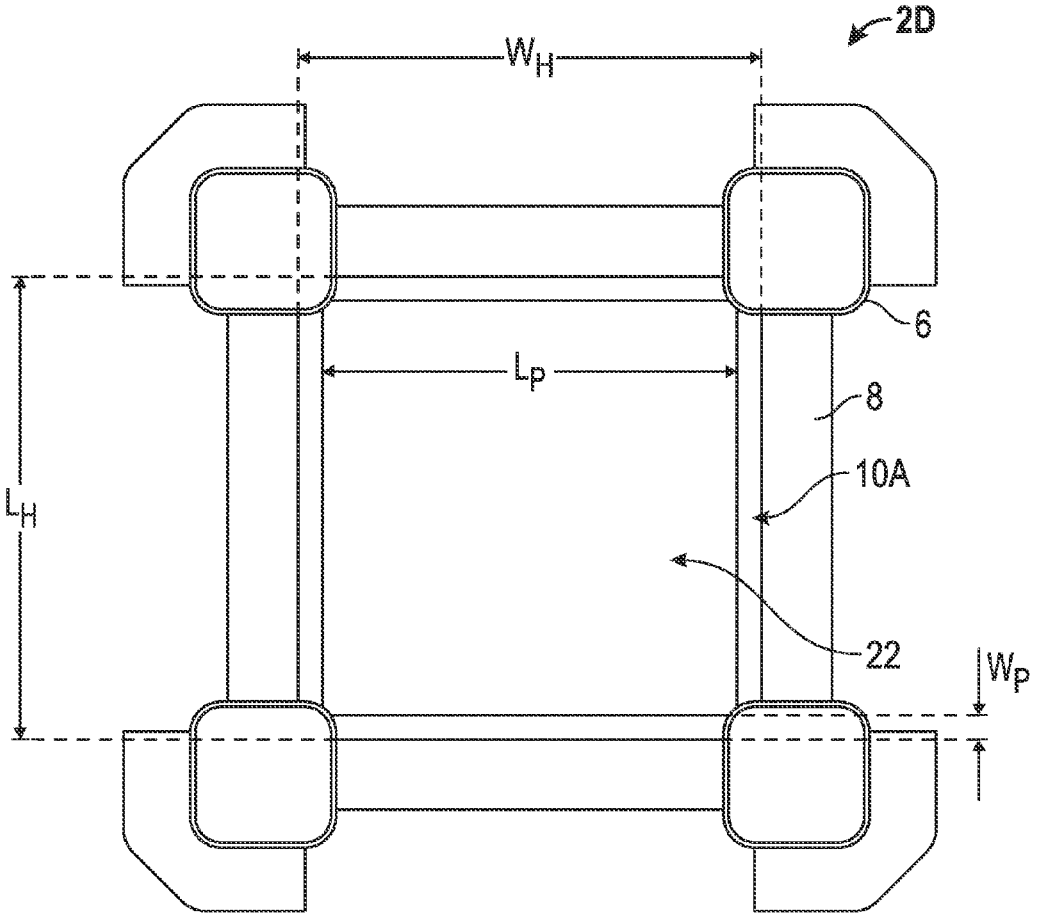
FIG. 6F is a schematic top view of the embodiment of FIG. 6A.

FIG. 6B is a cross sectional schematic perspective view of the embodiment of FIG. 6A. FIG. 6C is a cross sectional schematic side view of the embodiment of FIG. 6B. FIG. 6D is a detail cross sectional schematic view of extension plates coupled to a pontoon with water separation and water entrapment from FIG. 6C. FIG. 6E is a detail cross sectional schematic view of extension plates with wings coupled to a pontoon with water separation and water entrapment similar to the embodiment in FIG. 6D. FIG. 6F is a schematic top view of the embodiment of FIG. 6A. The figures will be described in conjunction with each other and the collective set of figures of the embodiment of FIGS. 6A-6F can be generally referenced as FIG. 6. While any of the above FIGS. 3-5 could be explained in detail, the embodiment shown in FIGS. 6A-6F will be described in further detail for illustrative purposes. It will be understood by those with ordinary skill in the art that the principles described in the embodiment of FIGS. 6A-6F can be also applied to the embodiments shown in FIGS. 3 through 5.

The offshore platform 2D of FIGS. 6A-6F with a plurality of column 6 and a plurality of pontoons 8 coupled to the columns form an inward perimeter of the hull having a hull opening 22. For the particular embodiment described, one or more extension plates 10A are fixedly coupled to a top portion 8A of one or more pontoons 8. Similarly, one or more extension plates 10B are fixedly coupled to a bottom portion 8B of more or more pontoons 8. In the illustrated embodiment, all of the pontoons 8 have each a top and bottom extension plate 10A, 10B. However, the invention is not so limited and different pontoons can have different extension plates and even in some cases, no extension plates, depending on particular design requirements for the operational environment of the offshore platform.

An important aspect of the present invention is the ability of the extension plates to cause water separation 38A, 38B, shown in FIG. 6D, as the extension plates oscillate with the offshore platform in response to wave motion. The water separation 38A, 38B surrounds each of the extension plates that are, for example, horizontally disposed from the vertical pontoon surface 8C of the pontoon 8. When a plurality of extension plates are used at different levels, each extension plate can cause water separation. For example, the extension plate 10A can cause water separation 38A and the extension plate 10B at a lower level from the extension plate 10A can cause water separation 38B. This water separation creates a drag on the offshore platform 2D and effectively acts as a damping force to restrain movement that would otherwise occur from the wave action on an offshore platform without the extension plates.

Further, the use of extension plates at different levels, such as above or below another extension plate, creates a water trap zone 40 illustrated in FIG. 6D. A portion of the water in the water trap zone 40 may not necessarily be separated as shown in the water separation 38A, 38B. However, the water in the water trap zone 40 is essentially restricted between the extension plates 10A, 10B and effectively adds mass to the structure of the offshore platform 2D. The water is not fixably coupled or fixably restrained and so is considered dynamic mass. Thus, as illustrated in FIG. 6D, the two principals of the effectiveness of the extension plates is: first, water separation around the edge of the extension plate, and secondly, when extension plates are positioned at different levels, the dynamic entrapment of water adds mass to the overall structure. The first mode creates drag, and the second mode creates mass.

Figure 11A:
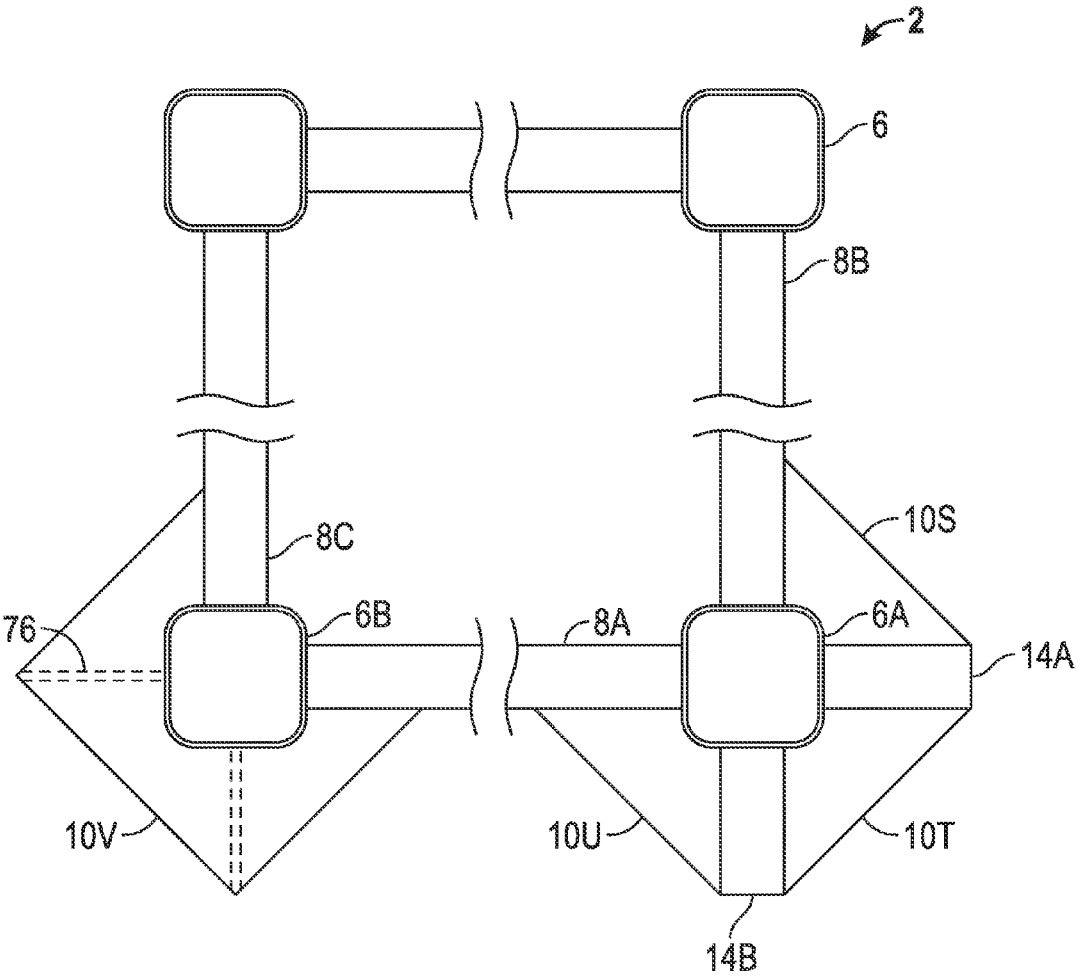
FIG. 11A is a schematic top view of other exemplary embodiments of a floating offshore platform having one or more extension plates fixedly coupled to one or more pontoons.
Figure 11B:
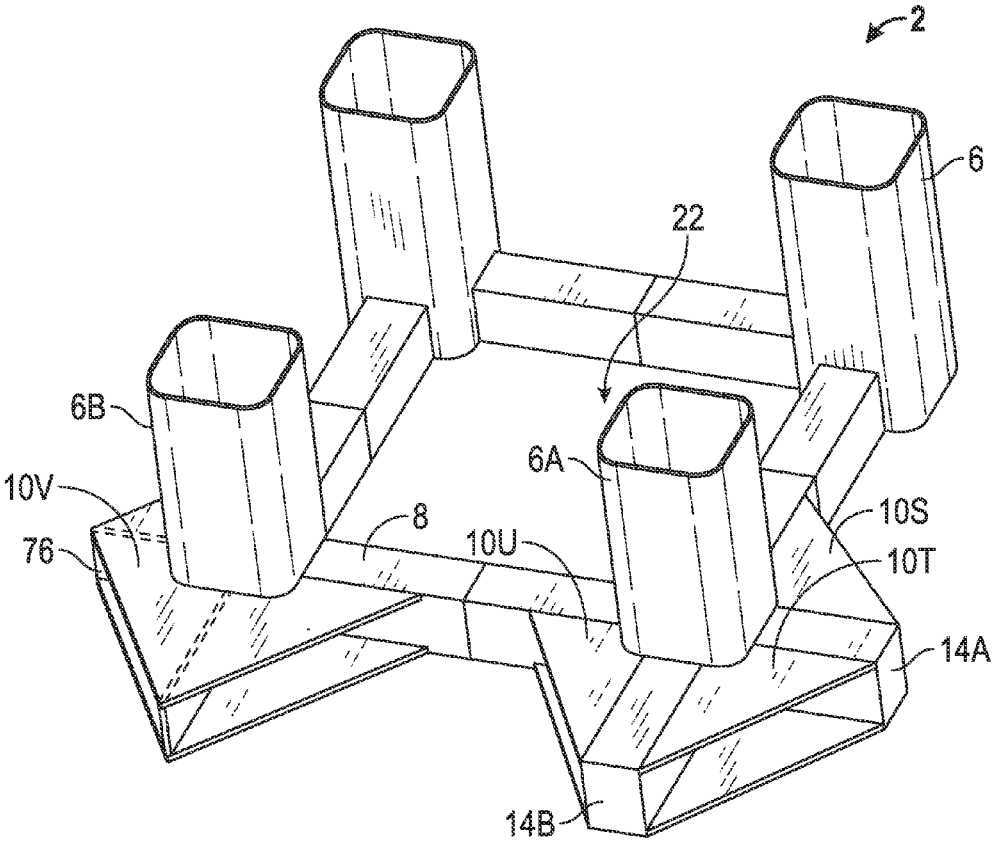
FIG. 11B is a perspective view of the embodiment of FIG. 11A.

As shown in FIG. 6E, the extension plates can include wings that are disposed at an angle to the extension plates. For example, the extension plates 10B could have a wing 64 formed in the shape of an "L" with the extension plate. Alternatively and with limitation, the extension plate 10A could have a wing 66 formed in the shape of a "T" with the extension plate. Various combinations of a wing or wings are envisioned, such as without limitation, one wing on either of the extension plates and the other extension plate, if present, having no wing; each extension plate having a "T" wing; each extension plate having an "L" wing; the extension plate 10A having an "L" wing and the extension plate 10B having a "T" wing, and other variations and combinations. The wings assist in entrapping the water on the extension plates as the extension plates move in the water. The wings 64, 66 help add drag and water mass to the extension plates 10A, 10B. The wings can be of different lengths as in FIG. 6E, and different lengths along the length of the extension plates, such as shown in FIGS. 6F, 11A, 11B.

The size of the one or more extension plates can determine the effectiveness of the water separation and the dynamic mass. For illustrative purposes, the ratio of the square area of the one or more extension plates when viewed from a top view compared to a square area of the hull opening 22 without the extension plates can be used. When multiple levels of extension plates are used, only one level of extension plates for example from a top view can be used for calculating the ratio of the surface area of the extension plates to the hull opening area. In the embodiment shown in FIG. 6F, the square area of each of the extension plates would be their respective length $L_P$×width $W_P$ for the extension plates around the perimeter of the pontoons from the top view. In the exemplary embodiment of the offshore platform 2D, the number of extension plates are four (4) for calculating the surface area, and would exclude any extension plates below the illustrated extension plates in the top view. The square area inside the hull of the hull opening 22 is equal to the $L_H$×$W_H$ as measured between the pontoons without the extension plates. The ratio of the extension plate area to the hull opening area can vary between 10% to 40%, as described above and any percentage therebetween. Further, if the offshore platform has fewer or more columns than the illustrated four columns in FIGS. 6A-6F, the shape of the hull opening 22 could vary and the square area inside the hull between the pontoons would be calculated as applicable to the particular structure.

Figure 7:
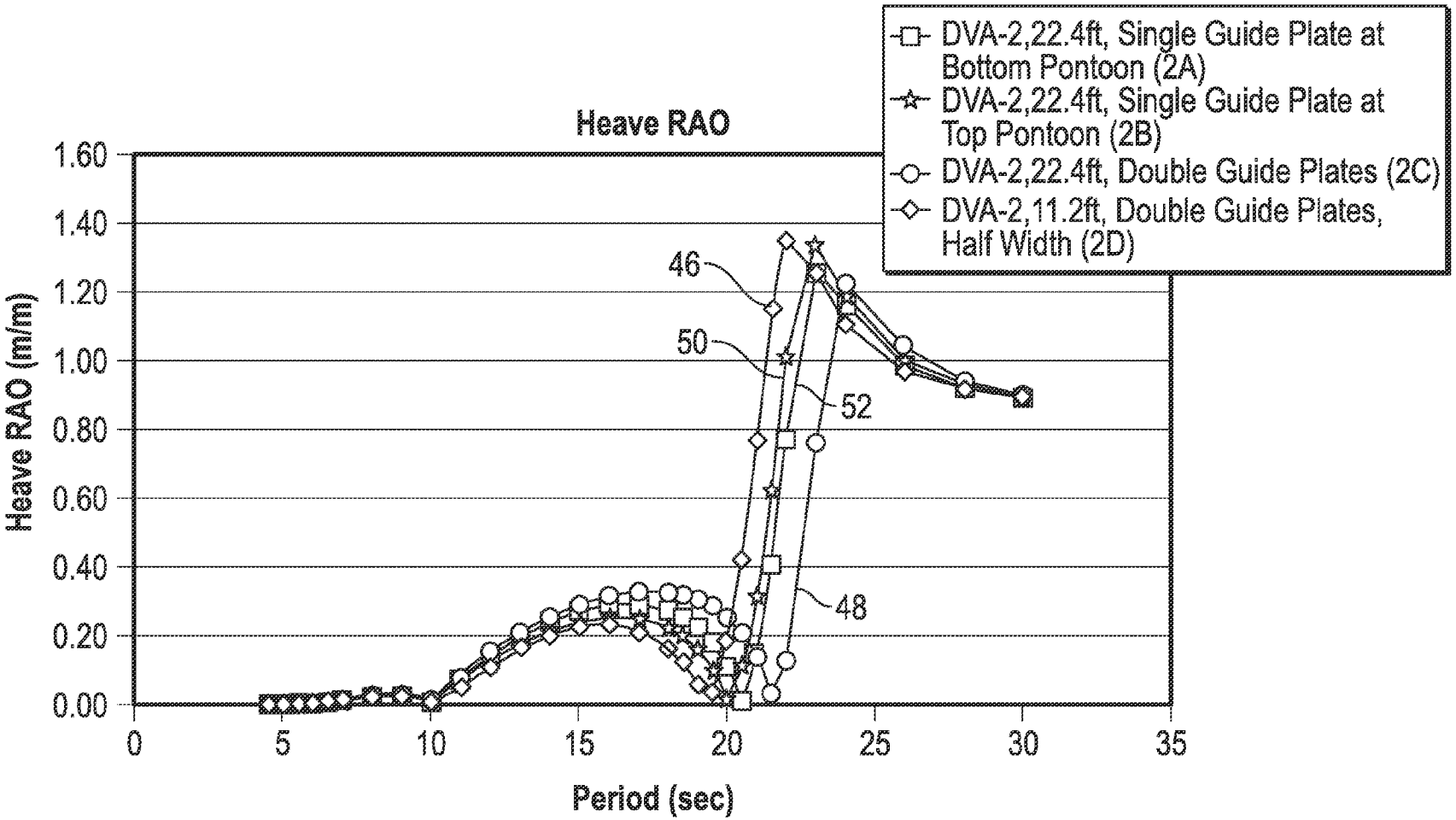
FIG. 7 is a chart of predicted heave RAO effects on the offshore platform embodiments illustrated in FIGS. 3-6A based on a typical design heave period.

FIG. 7 is a chart of predicted heave RAO effects on the offshore platform embodiments illustrated in FIGS. 3-6A that is stabilized by the extension plate based on a typical design heave period. The X-axis is the time in seconds of a heave period and the natural period of the offshore platform 2 without the extension plate 10 and with the extension plate. The Y-axis represents the response amplitude operator (RAO), a known term of art in vessel design for responding to the movement of a vessel in proportion to a wave height. For the illustrative purposes of the predictive model performance shown in FIGS. 7 and 8, the square area of the extension plates for the exemplary platforms when viewed from the top was 37% of the hull opening 22, with the exception of the platform shown FIG. 6A in which the extension plate surface area was 10% of the hull opening 22. Effectively, the extension plate lengthens the offshore platform period and the resonance of such period, so that the offshore platform is more stabilized and its movement is dampened at the design period. Thus, the offshore platform movement does not move in direct correlation to the wave passing by the offshore platform.

The curve 46 with diamonds illustrates a relatively low heave RAO for the offshore platform 2D illustrated in FIG. 6A compared to a typical values for a similar platform without the extension plates. The offshore platform 2D includes a double level of extension plates, that is, extension plates 10A attached to a top portion of the pontoons and extension plates 10B attached to the bottom portion of the pontoons. The surface area of the extension plates in the exemplary model that generated the curve is 10% of the surface area of the hull opening 22 without the extension plates when viewed from the top view.

The curve 48 with circles illustrates the heave RAO for the offshore platform 2C illustrated in FIG. 5. The embodiment of the offshore platform 2C is similar to the offshore platform 2D illustrated in FIG. 6A with two levels of extension plates on the top and bottom portions of the pontoons, but with wider extension plates extending inwardly from the pontoons. The curve 48 was generated based on the extension plates having a square area of 37% of the hull opening square area. The curve 48 illustrates that the increased square area of the extension plates shifts the heave RAO to a greater heave period and reduces the heave modal response to waves. However, the environment increases the wave response over the frequency range from 10 to 22 seconds. The heave period changes from 21 to 24.

The curve 50 with stars illustrates the heave RAO for the offshore platform 2B illustrated in FIG. 4. The offshore platform 2B has a single level of extension plates located toward the top portion of the pontoons. The surface area of the extension plates for this exemplary model is 37% of the square area of the hull opening 22. The curve 50 illustrates that the heave RAO is shifted to the right compared to the embodiment illustrated in FIG. 6A to a greater heave period and reduces the heave modal response to waves. However, the environment increases the wave response over the frequency range from 10 to 22 seconds. The heave period changes from 21 to 22.

The curve 52 with squares illustrates the heave RAO for the offshore platform 2A illustrated in FIG. 3. The offshore platform 2A has the single layer of extension plates coupled to a bottom portion of the pontoons. In the exemplary model, the square area of the extension plates was 37% compared to the square area of the hull opening 22. The curve 52 illustrates that the heave RAO is shifted to the right from the curve 50 to a greater heave period and reduces the heave modal response to waves. However, the environment increases the wave response over the frequency range from 10 to 22 seconds. The heave period changes from 21 to 22.

Figure 8:
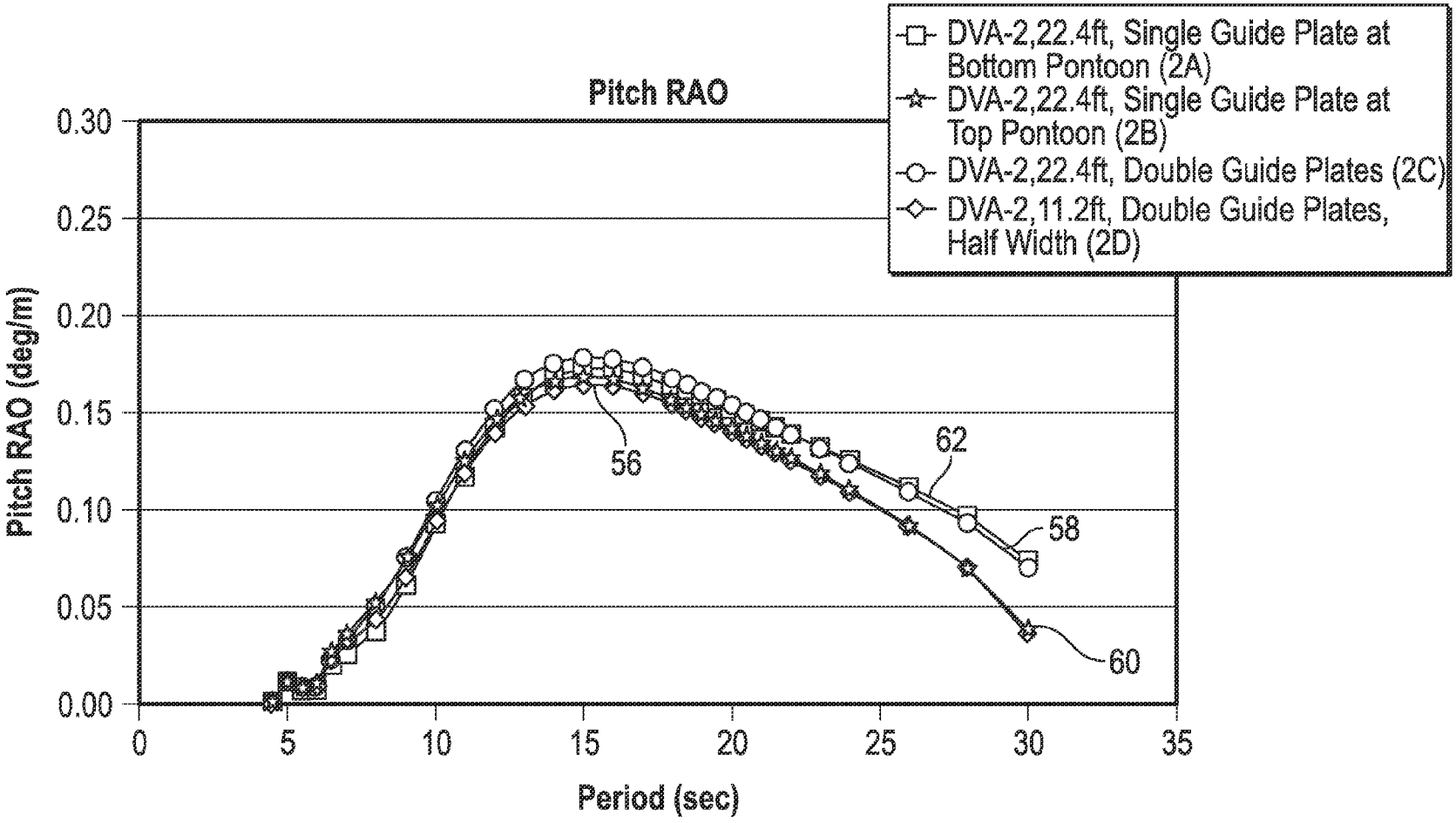
FIG. 8 is a chart of predicted pitch RAO effects on the offshore platform embodiments illustrated in FIGS. 3-6A based on a typical design heave period.

FIG. 8 is a chart of predicted pitch RAO effects on the offshore platform embodiments illustrated in FIGS. 3-6A based on a typical design heave period. The pitch differs from the heave in that the pitch is the angular movement away from a vertical line of the offshore platform in response to the wave action, compared to the heave which is measure of the vertical motion along the vertical axis of the offshore platform in response to wave action. The curve 56 with diamonds illustrates a relatively low pitch RAO for the offshore platform 2D illustrated in FIG. 6A compared to a typical offshore platform without the extension plates. The curve 58 with circles illustrates the pitch RAO for the offshore platform 2C illustrated in FIG. 5. The curve 60 with stars illustrates the pitch RAO for the offshore platform 2B illustrated in FIG. 4. The curve 62 with squares illustrates the pitch RAO for the offshore platform 2A illustrated in FIG. 3.

The pitch RAO consistently peaked for all curves at a period of around 15 seconds. However, the lowest pitch RAO was in curve 56 for the embodiment of the offshore platform 2D in FIG. 6A. The highest pitch RAO was in curve 62 for the embodiment of the offshore platform 2A in FIG. 3. The remaining embodiments had curves for the pitch RAO values that occurred between the curves 64 and 62.

Figure 9:
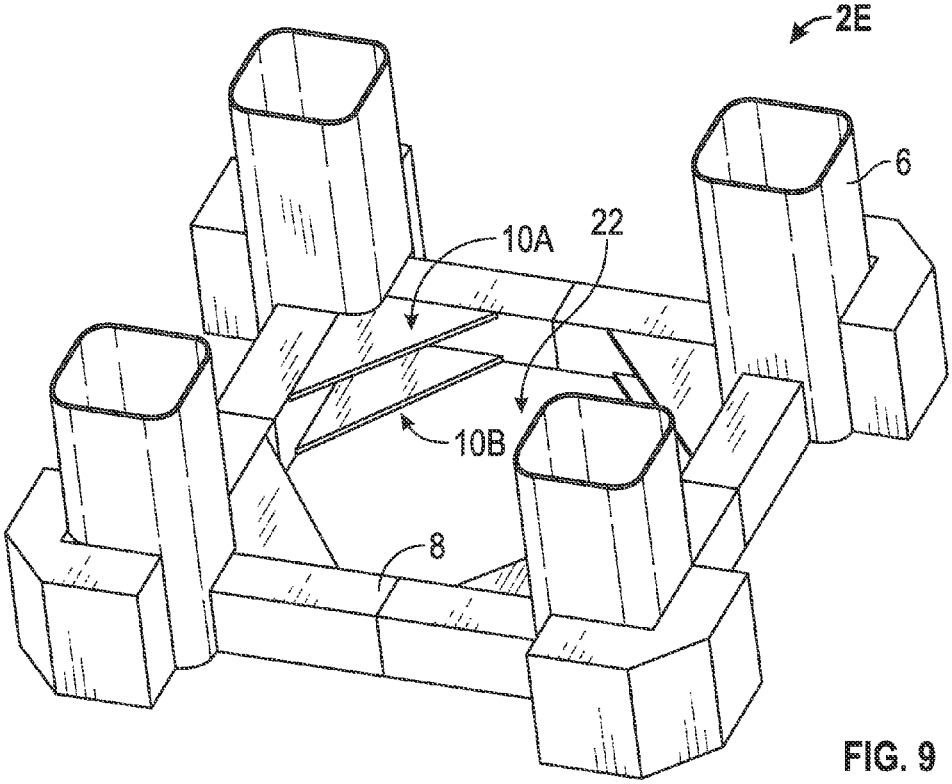
FIG. 9 is a schematic perspective view of another exemplary embodiment of a floating offshore platform having one or more extension plates fixedly coupled to a bottom portion and a top portion of at least two pontoons.

FIG. 9 is a schematic perspective view of another exemplary embodiment of a floating offshore platform having one or more extension plates fixedly coupled to a bottom portion and a top portion of at least two pontoons. An offshore platform 2E has an alternative arrangement of extension plates 10A, 10B. The extension plates 10A, 10B can be coupled to a plurality of pontoons, such as in the corner, so that two pontoons could be coupled to the same extension plate. Two levels of extension plates 10A and 10B are illustrated. Extension plate 10B is lower than extension plate 10A and is coupled to a bottom portion of the pontoons 8. Extension plate 10A is coupled to a top portion of the pontoons 8. Other embodiments would include a single level of extension plates and various combinations of extension plates with the extension plates shown or described in other embodiments herein. Further, the square area of the extension plates could be calculated based on the geometrical shape of the extension plates from a top view.

Figure 10:
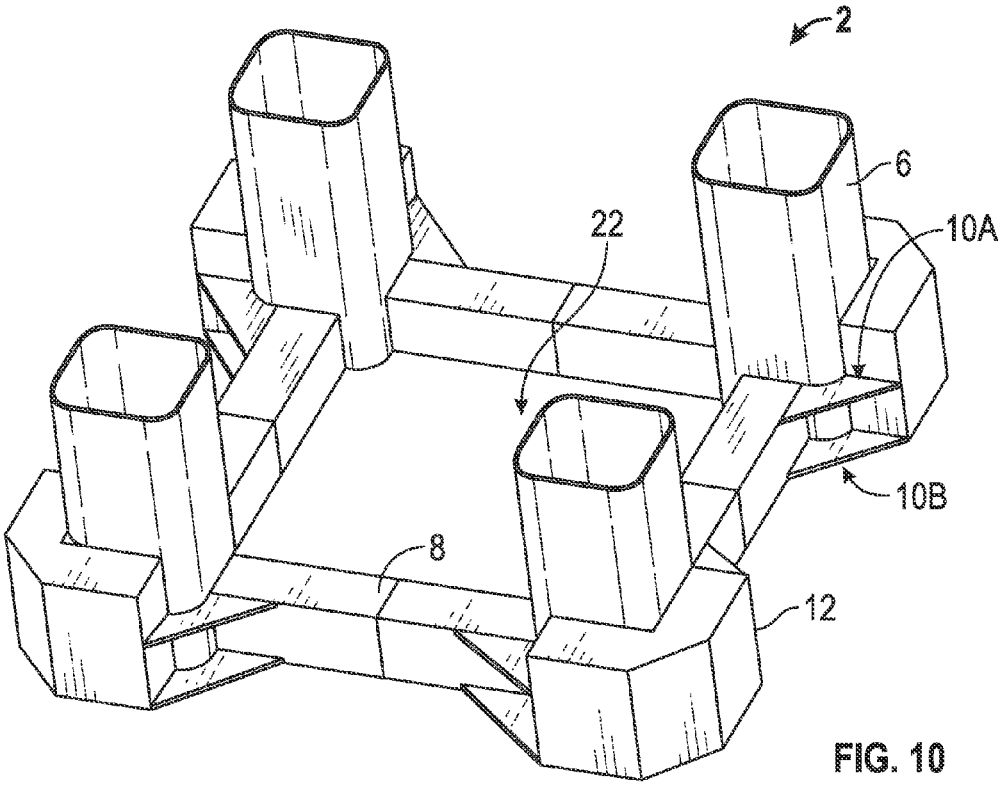
FIG. 10 is a schematic top view of another exemplary embodiment of a floating offshore platform having one or more extension plates fixedly coupled to one or more pontoons.

FIG. 10 is a schematic top view of another exemplary embodiment of a floating offshore platform having one or more extension plates fixedly coupled to one or more pontoons. An offshore platform 2 has an alternative arrangement of extension plates 10A, 10B. The extension plates 10A, 10B can be coupled to a plurality of pontoons and columns 6, such as at the column bases 12 of the columns. Further, the extension plates 10A, 10B can be coupled between a pontoon and the column on both sides of the column as shown. Alternatively, the extension plates can be coupled only on one side of the column. Two levels of extension plates 10A and 10B are illustrated. Extension plate 10B is lower than extension plate 10A and is coupled to a bottom portion of the pontoons 8. Extension plate 10A is coupled to a top portion of the pontoons 8. Other embodiments could include a single level of extension plates and various combinations of extension plates with the extension plates shown or described in other embodiments herein. Further, the square area of the extension plates could be calculated based on the geometrical shape of the extension plates from a top view as discussed or shown in other Figures herein.

FIG. 11A is a schematic top view of other exemplary embodiments of a floating offshore platform having one or more extension plates fixedly coupled to one or more pontoons. FIG. 11B is a perspective view of the embodiment of FIG. 11A. The figures will be described in conjunction with each other. An offshore platform 2 has various alternative embodiments of extension plates illustrated for the various columns 6 that can be used on multiple columns or all columns of the offshore platform, or in combination with each other around the various columns, or in combination with other embodiments described or shown in other Figures herein.

In one embodiment shown around column 6A, a pontoon 8*a* includes a pontoon extension 14A. The pontoon extension 14A can be a direct extension from the pontoon 8A with the column 6A coupled to the pontoon and/or pontoon extension, or the pontoon extension 14A can be coupled as an indirect extension from the pontoon 8A with the column 6A separating the pontoon 8A and the pontoon extension 14A. A similar arrangement can be formed by the pontoon extension 14B relative to the pontoon 8B. The pontoons 8A and 8B are disposed at a non-zero angle to each other. An extension plate 10S can be coupled to a pontoon 8B and the pontoon extension 14A disposed at an angle to the pontoon 8B. An extension plate 10T can be coupled between the pontoon extensions 14A and 14B (and indirectly coupled to the pontoons). An extension plate 10U can be coupled to a pontoon 8A and the pontoon extension 14B. As described in other embodiments, multiple layers of plates at different elevations can be coupled in like fashion.

As another embodiment shown around column 6B, an extension plate 10V can be coupled around the column 6B and be coupled to the pontoons 8A and 8C. The size of the extension plate (and other extension plates in the various embodiments herein) may advantageously benefit from a plate support 76 to stiffen the extension plate. Other embodiments may not use a plate support. If two extension plates are used at different elevations, the plate support 76 can be coupled between the extension plates.

Figure 12:
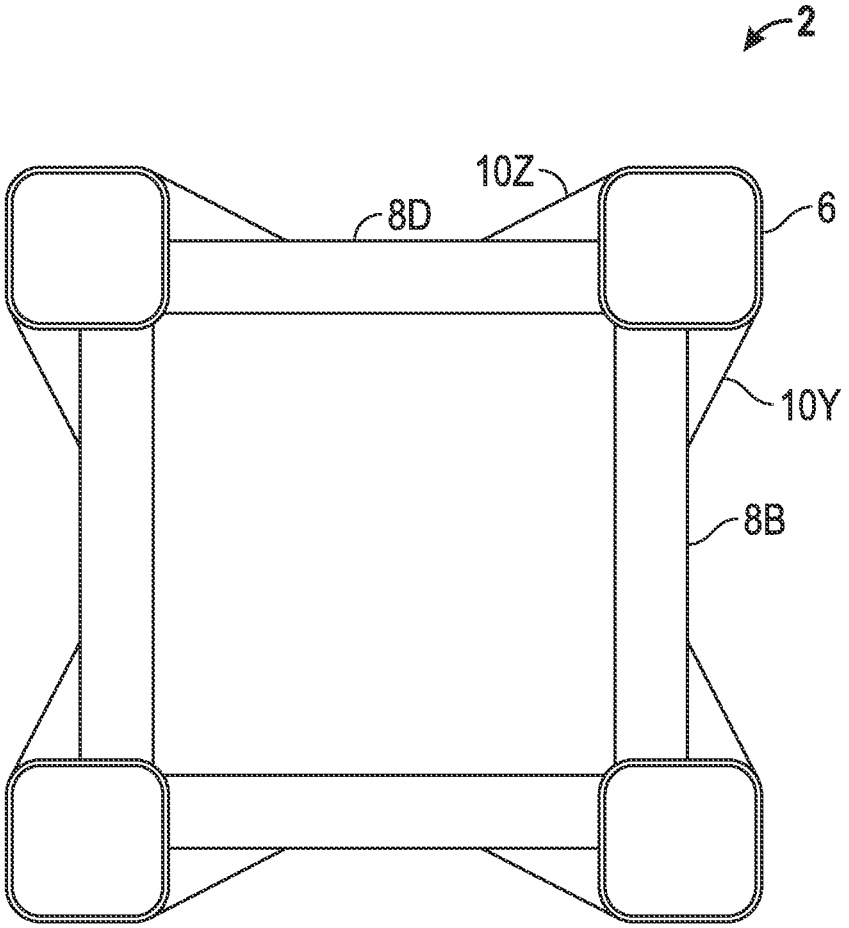
FIG. 12 is a schematic top view of another exemplary embodiment of a floating offshore platform having one or more extension plates fixedly coupled to one or more pontoons.

FIG. 12 is a schematic top view of another exemplary embodiment of a floating offshore platform having one or more extension plates fixedly coupled to one or more pontoons. FIG. 12 is similar in some respects to the embodiment shown in FIG. 10 without the column base 12. An extension plate 10Y can be coupled to a column 6 and a pontoon 8B. An extension plate 10Z can be coupled to the column 6 and a pontoon 8D. As described in other embodiments, multiple layers of plates at different elevations can be coupled in like fashion. Other embodiments could include a single level of extension plates and various combinations of extension plates shown or described or shown in other Figures herein. Further, the square area of the extension plates could be calculated based on the geometrical shape of the extension plates from a top view.

Figure 13:
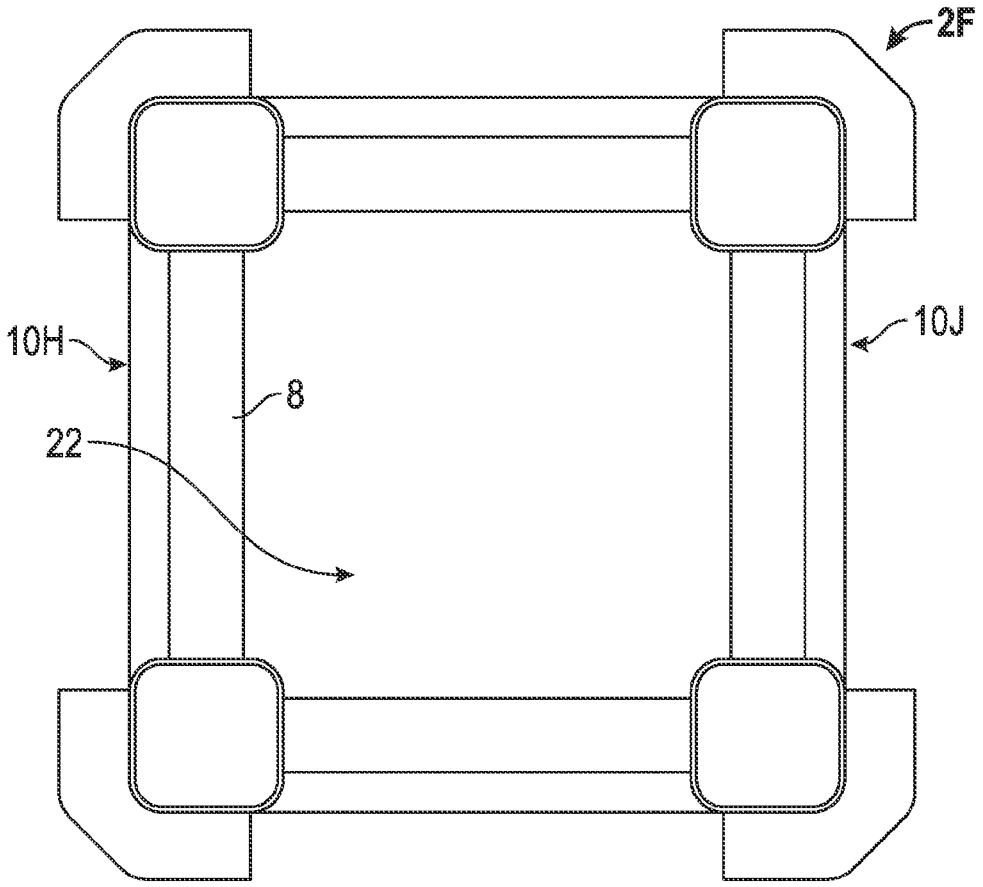
FIG. 13 is a schematic perspective view of another exemplary embodiment of a floating offshore platform having one or more extension plates coupled outwardly from one or more pontoons.

FIG. 13 is a schematic perspective view of another exemplary embodiment of a floating offshore platform having one or more extension plates coupled outwardly from one or more pontoons. The offshore platform 2F shows one or more extension plates 10H, 10J coupled to one of more of the pontoons 8 outwardly from the pontoons. The extension plates can have similar surface areas as has been described above relative to the square area of the hull opening 22. The extension plates could be coupled to a top portion, bottom portion, or both. Further, some extension plates can be located inwardly on some of the pontoons, while other extension plates could be located outwardly on some of the pontoons. The term "inwardly" is toward a center of the hull relative to the pontoon of the respective extension plate, and "outwardly" is away from the center of the hull relative to the pontoon of the respective extension plate. The different combinations can be modelled to determine an appropriate placement for given conditions in which the offshore platform may be used.

Figure 14A:
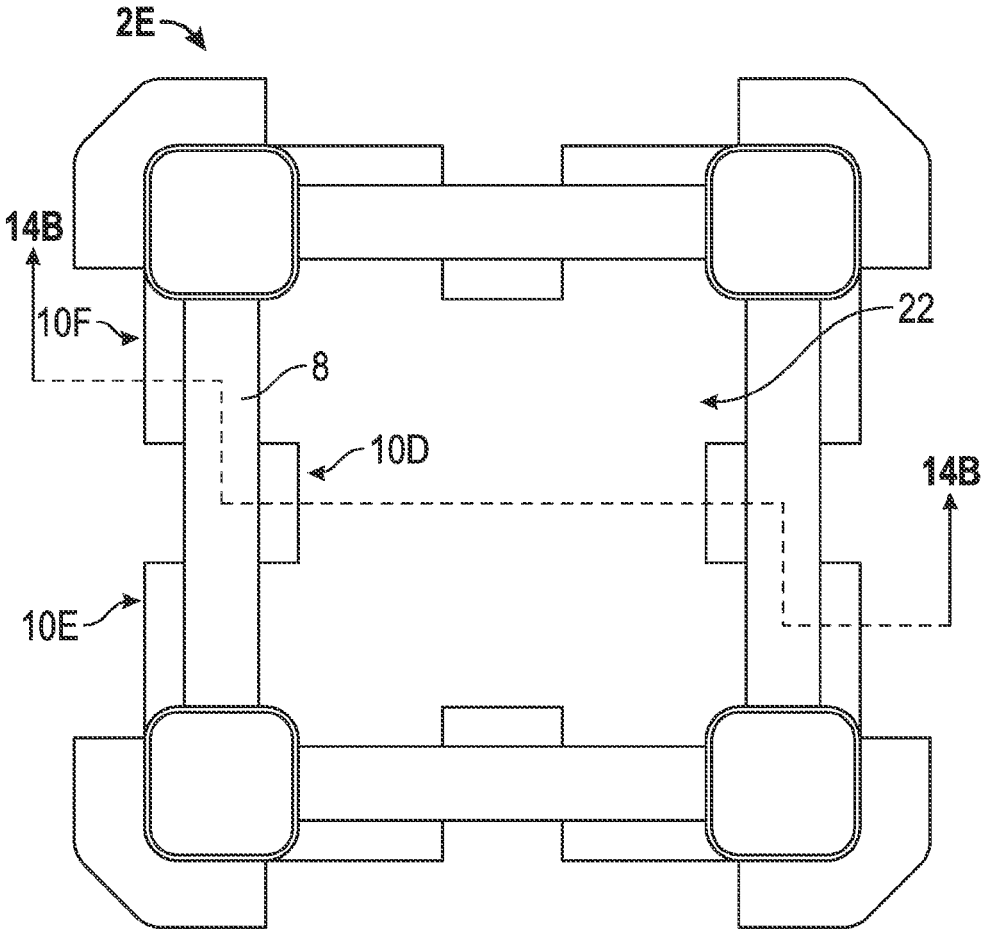
FIG. 14A is a schematic perspective view of another exemplary embodiment of a floating offshore platform having one or more extension plates fixedly coupled along one or more portions of a pontoon.
Figure 14B:
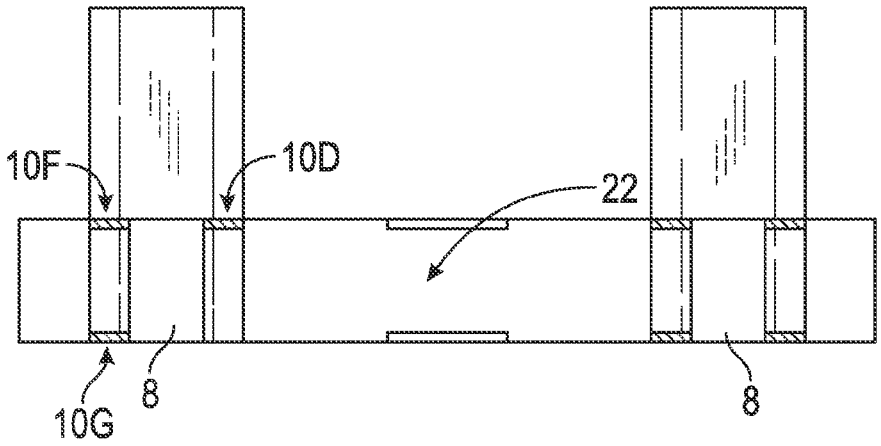
FIG. 14B is a cross sectional schematic side view of a pontoon in the embodiment of shown in FIG. 14A.

FIG. 14A is a schematic perspective view of another exemplary embodiment of a floating offshore platform having one or more extension plates fixedly coupled along one or more portions of a pontoon. FIG. 14B is a cross sectional schematic side view of a pontoon in the embodiment of shown in FIG. 14A. The figures will be described in conjunction with each other. The offshore platform 2E includes various extension places positioned around one of more of the pontoons in non-contiguous segments along the pontoons. Some extension plates can be coupled to the bottom portion of the pontoons, such as extension plate 10G. Other extension plates, such as extension plates 10F, 10D, can be coupled to the top portion of the pontoons. Some extension plates can be coupled outwardly of the pontoons, such as extension plates 10E, 10F, and other extension plates can be coupled inwardly of the pontoons, such as extension plate 10D. Some extension plates can have a corresponding double level of extension plates, such as extension plate 10F, 10G, and other extension plates can be a single level, such as extension plate 10D with no corresponding extension plate below or above such extension plate.

Further, some pontoons can be asymmetric to other pontoons of the hull, as illustrated in FIG. 14B. A pontoon might have a double level of extension plates on one side and a single level of extension plates on the other side, but another pontoon might have double levels of extension plates on both sides or single level of extension plates on both sides. The total surface area of the extension plates illustrated in FIG. 14A when viewed from a top view can be within the range discussed above as a ration of the square area of the hull opening 22.

Figure 15:
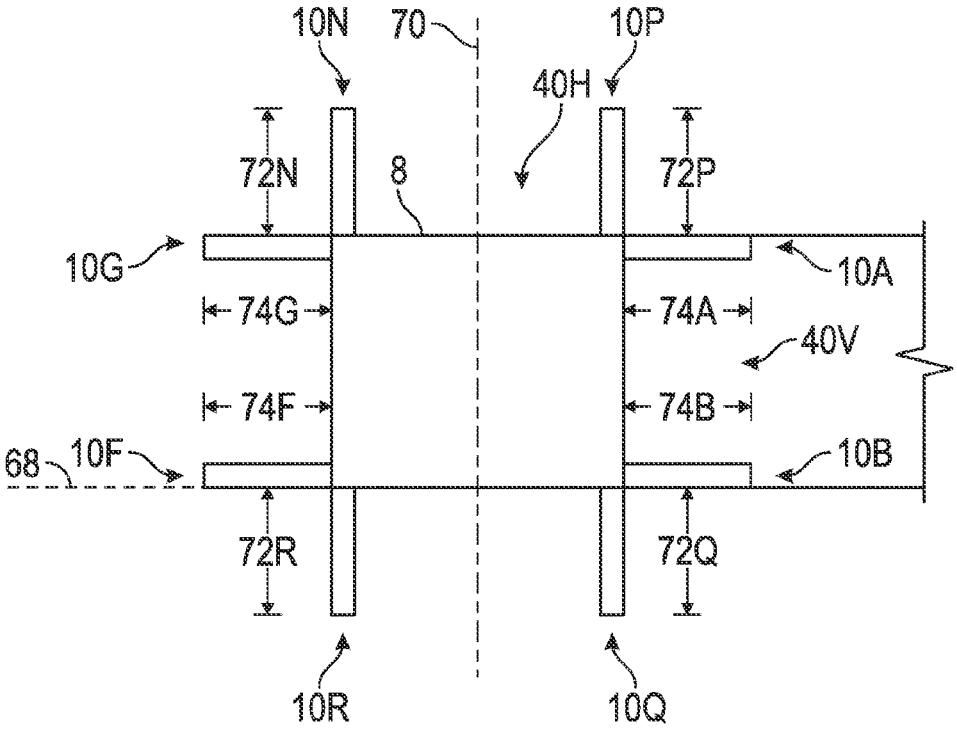
FIG. 15 is a cross sectional schematic side view of another exemplary embodiment of a pontoon on the floating offshore platform having one or more extension plates fixedly coupled along one or more portions of the pontoon.

FIG. 15 is a cross sectional schematic side view of another exemplary embodiment of a pontoon on the floating offshore platform having one or more extension plates fixedly coupled along one or more portions of the pontoon. The pontoon 8 includes one or more extension plates 10 disposed at an orthogonal angle to a horizontal plane 68 or a vertical plane 70. In the exemplary embodiment shown, the horizontal extension plates 10A, 10B, 10F, 10G extend parallel to the horizontal plane 68 and perpendicular to the vertical plane 70. The vertical extension plates 10N, 10P, 10Q, 10R extend perpendicular to the horizontal plane 68 and parallel to the vertical plane 70. The extension plates can be used in combination with the other embodiments such as only horizontal plates, only vertical plates, angled plates, with wings, and other variations described herein, or a combination thereof. The extension plates form a width perpendicular to the horizontal plane 68 or vertical plane 70, depending on the orientation of the particular extension plates. The horizontal extension plates 10A and 10B form horizontal widths 74A and 74B, respectively, that are parallel to the horizontal plane 68. Similarly, the horizontal extension plates 10F and 10G form horizontal widths 74F and 74G, respectively, that are parallel to the horizontal plan 68. The vertical extension plates 10P and 10Q form vertical widths 72P and 72Q, respectively, that are parallel to the vertical plane 70. Similarly, the vertical extension plates 10R and 10N form vertical widths 72R and 72N, respectively, that are parallel to the vertical plane 70. The widths multiplied by the length of the respective plate yields the square area for the respective plate when viewed from orthogonal planes such as the horizontal plane 68 and vertical plane 70. Similar to the dimensions described above, the horizontal extension plates can have a surface area that is 10% to 40%, inclusively, and any percentage therebetween, of the square area of a hull opening described above. For multiple levels of horizontal extension plates, the square area of the extension plates when viewed from a top view can be considered, so that one level of the extension plates is calculated for the square area. The vertical extension plates can also have a surface area that is 10% to 40%, inclusively, and any percentage therebetween as described above, of the square area of a hull opening. For multiple levels of vertical extension plates, the square area of the vertical extension plates when viewed from an outside position toward the pontoon 8 can be considered, so that one level of the extension plates is calculated for the square area. For example, in calculating the square area along the top surface of the pontoon 8 in FIG. 15, the square area of the extension plate 10N could be considered for the range of 10% to 40%, exclusive of the square area of the extension plate 10P, when viewed from an outside position toward the pontoon.

As explained above in the discussion regarding FIG. 6D, the extension plates create water separation over the plates as the structure moves and therefore drag on the movement. Further, when plates are on the same side of the pontoon, the zone between the plates creates a water trap zone and effectively adds dynamic mass to the structure of the offshore platform 2. In this embodiment, an analysis of the horizontal extension plates 10A and 10B show that the combination of the horizontal widths 74A and 74B, respectively, creates drag in the vertical plane 70 and therefore resists vertical movement of the offshore platform 2. Also, the combination of the horizontal widths 74A and 74B of the extension plates 10A and 10B, respectively, creates a vertical water trap zone $\mathbf{40}_V$ that creates vertical dynamic mass on the structure and therefore resists vertical movement and the added mass also increases the heave modal period and thus reduces the wave excitation response of the offshore platform. The extension plates 10F and 10G can cause similar results.

An analysis of the vertical extension plates 10N and 10P show that the combination of the vertical widths 72N and 72P, respectively, creates drag in the horizontal plane 68 and therefore resists horizontal movement of the offshore platform 2. Also, the combination of the horizontal widths 72N and 72P of the extension plates 10N and 10P, respectively, creates a horizontal water trap zone $\mathbf{40}_H$ that creates horizontal dynamic mass on the structure and therefore resists horizontal movement of the offshore platform. The extension plates 10Q and 10R can cause similar results. The vertical extension plates can be smaller in width than the horizontal extension plates.

Figure 16:
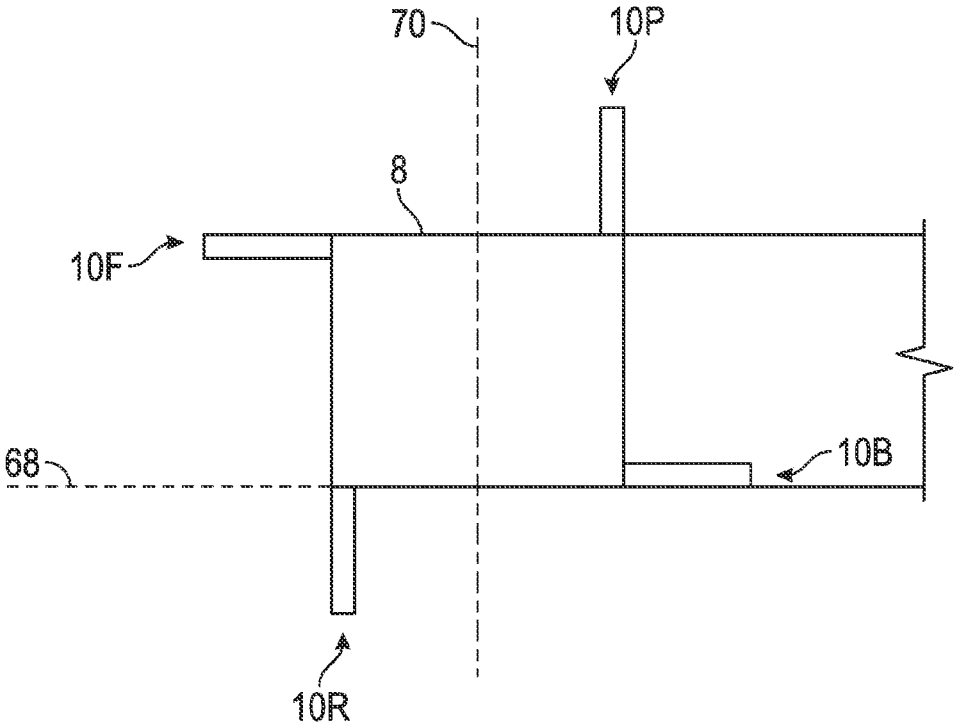
FIG. 16 is a cross sectional schematic side view of another exemplary embodiment of a pontoon on the floating offshore platform having one or more extension plates fixedly coupled along one or more portions of the pontoon.

FIG. 16 is a cross sectional schematic side view of another exemplary embodiment of a pontoon on the floating offshore platform having one or more extension plates fixedly coupled along one or more portions of the pontoon. FIG. 16 can be described in a similar manner as in FIG. 15 with the primary difference of at least one of the sides having a single extension plate. For example, the extension plate 10A could be disposed on a side surface of the pontoon 8, the extension plate 10N could be disposed on a top surface of the pontoon 8, with extension plates 10F and 10R being similarly disposed on their respective pontoon surface. Thus, on the surfaces having a single extension plate, the extension plate would cause drag in the orthogonal direction to the width of the extension plate, but not necessarily cause a water trap zone without an adjacent extension plate on the surface. However, a single plate will contribute to the dynamic added mass.

Figure 17:
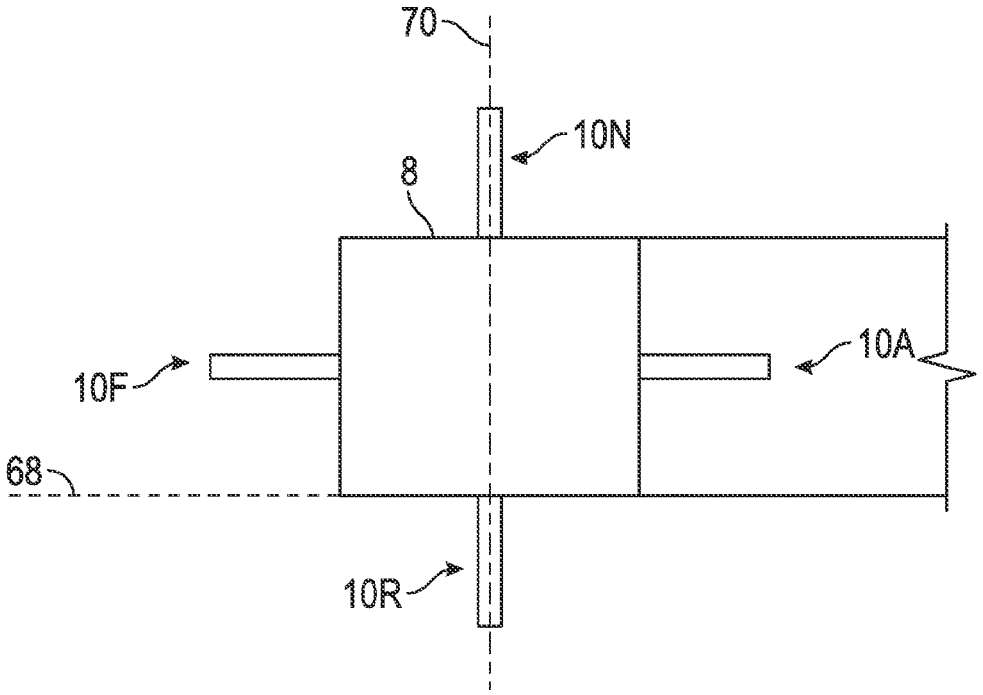
FIG. 17 is a cross sectional schematic side view of another exemplary embodiment of a pontoon on the floating offshore platform having one or more extension plates fixedly coupled along one or more portions of the pontoon.

FIG. 17 is a cross sectional schematic side view of another exemplary embodiment of a pontoon on the floating offshore platform having one or more extension plates fixedly coupled along one or more portions of the pontoon. FIG. 17 can be described in a similar manner as in FIG. 15 with the primary difference of at least one of the sides having a single extension plate, as in FIG. 16. For example, the extension plate 10B could be disposed on a side surface of the pontoon 8, the extension plate 10P could be disposed on a top surface of the pontoon 8, with extension plates 10F and 10R being similarly disposed on their respective pontoon surface. Thus, on the surfaces having a single extension plate, the extension plate would cause drag in the orthogonal direction to the width of the extension plate, but not necessarily cause a water trap zone without an adjacent extension plate on the surface. However, a single plate will contribute to the dynamic added mass.

Figure 18:
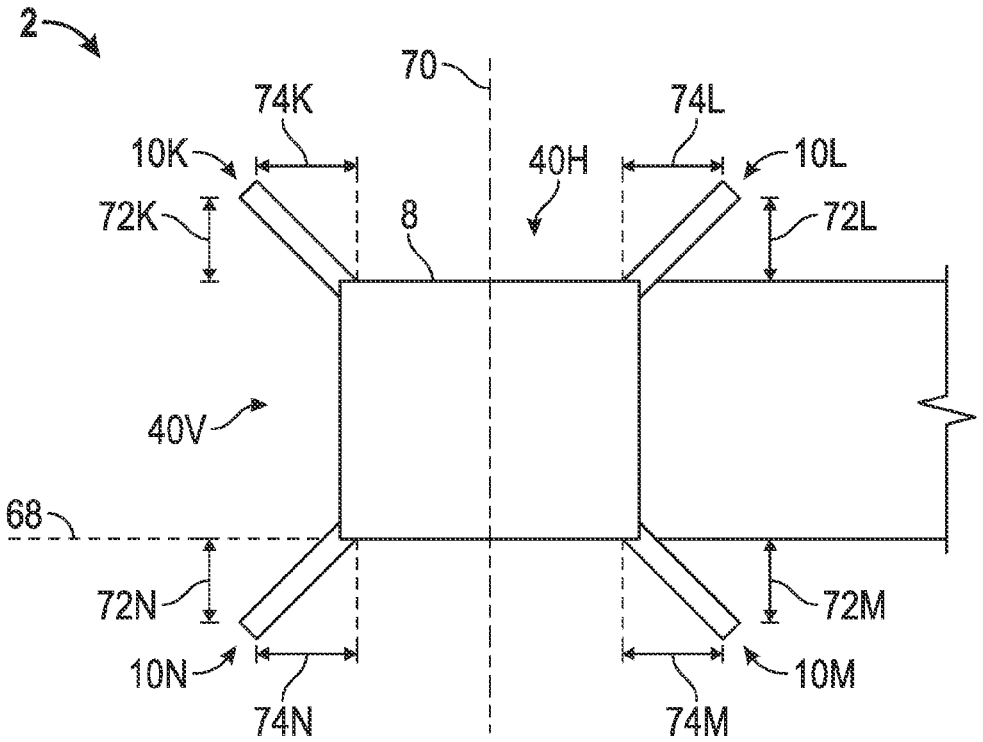
FIG. 18 is a cross sectional schematic side view of another exemplary embodiment of a pontoon on the floating offshore platform having one or more extension plates fixedly coupled along one or more portions of the pontoon.

FIG. 18 is a cross sectional schematic side view of another exemplary embodiment of a pontoon on the floating offshore platform having one or more extension plates fixedly coupled along one or more portions of the pontoon. The pontoon 8 includes one or more extension plates 10 disposed at an angle to a horizontal plane 68, or a vertical plane 70, or both planes. In the exemplary embodiment shown, the extension plates 10K, 10L, 10M, 10N extend at an angle to both planes about the pontoon. The angled extension plates can be used in combination with the other embodiments described herein, such as in combination with embodiments having horizontal extension plates, vertical extension plates, or a combination thereof. Further, the angled extension plates can be disposed at any originated and direction, and can be symmetric or asymmetric relative to other extension plates. The angled extension plates form an effective width perpendicular to the horizontal plane 68 and vertical plane 70. For example, the extension plate 10K forms a vertical effective width 72K perpendicular to the horizontal plane 68 and a horizontal effective width 74K perpendicular to the vertical plane 70. Likewise, the extension plate 10L forms a horizontal effective width 74L perpendicular to the vertical plane 70 and a vertical effective width 72L perpendicular to the horizontal plane 68. The extension plate 10M forms a horizontal effective width 74M perpendicular to the vertical plane 70 and a vertical effective width 72M perpendicular to the horizontal plane 68. The extension plate 10N forms a vertical effective width 72N perpendicular to the horizontal plane 68 and a horizontal effective width 74K perpendicular to the vertical plane 70. The effective widths multiplied by the length of the respective plate yields the effective square area for the respective plate when viewed from an orthogonal planes such as the horizontal plane 68 and vertical plane 70. The effective widths can be used to calculate the surface area of the plates in the range of 10% to 40% and any percentage therebetween when viewed parallel along the horizontal plane from outside the pontoon 8 and when viewed parallel along the vertical plane from a top view, similar to the calculations described in reference to FIG. 15.

As explained above in the discussion regarding FIG. 6D, the extension plates create water separation over the plates as the structure moves and therefore drag on the movement. Further, when plates are on the same side of the pontoon, the zone between the plates creates a water trap zone and effectively adds dynamic mass to the structure of the offshore platform 2. In this embodiment, an analysis of the extension plates 10K and 10N show that the combination of the vertical effective widths 72K and 72N of the extension plates 10K and 10N, respectively, creates drag in the horizontal plane 68 and therefore resists horizontal movement of the offshore platform 2. The combination of the horizontal effective widths 74K and 74N of the extension plates 10K and 10N, respectively, creates drag in the vertical plane 70 and therefore resists vertical movement of the offshore platform 2. Also, the combination of the horizontal effective widths 74K and 74N of the extension plates 10K and 10N, respectively, creates a vertical water trap zone $\mathbf{40}_V$ that creates vertical dynamic mass on the structure and therefore resists vertical movement of the offshore platform. The extension plates 10L and 10M can cause similar results.

Similarly, an analysis of the extension plates 10K and 10L show that the combination of the horizontal effective widths 74K and 74L of the extension plates 10K and 10L, respectively, creates drag in the vertical plane 70 and therefore resists vertical movement of the offshore platform 2. The combination of the vertical effective widths 72K and 72L of the extension plates 10K and 10L, respectively, creates drag in the horizontal plane 68 and therefore resists vertical movement of the offshore platform 2. Also, the combination of the vertical effective widths 72K and 72L of the extension plates 10K and 10L, respectively, creates a horizontal water trap zone $\mathbf{40}_H$ that creates horizontal dynamic mass on the structure and therefore resists horizontal movement of the offshore platform. The extension plates 10N and 10M can cause similar results.

Other and further embodiments utilizing one or more aspects of the inventions described above can be devised without departing from the spirit of Applicant's invention. For example, it is possible to have different supporting structures and frames for the extension, the extension can be divided into portions that may or may not be contiguous, the extension can be located at different elevations below the water surface when in use, the gap spacing can be different proportions and distances, the floating offshore platform design can vary, the number of columns and pontoons and their shape and size can vary, and other variations in keeping with the scope of using one or more extension plates to stabilize the floating offshore platform.

Further, the various methods and embodiments described herein can be included in combination with each other to produce variations of the disclosed methods and embodiments. Discussion of singular elements can include plural elements and vice-versa. References to at least one item followed by a reference to the item may include one or more items. Also, various aspects of the embodiments could be used in conjunction with each other to accomplish the understood goals of the disclosure. Unless the context requires otherwise, the word "comprise" or variations such as "comprises" or "comprising," should be understood to imply the inclusion of at least the stated element or step or group of elements or steps or equivalents thereof, and not the exclusion of a greater numerical quantity or any other element or step or group of elements or steps or equivalents thereof. The device or system may be used in a number of directions and orientations. The term "coupled," "coupling," "coupler," and like terms are used broadly herein and may include any method or device for securing, binding, bonding, fastening, attaching, joining, inserting therein, forming thereon or therein, communicating, or otherwise associating, for example, mechanically, magnetically, electrically, chemically, operably, directly or indirectly with intermediate elements, one or more pieces of members together and may further include without limitation integrally forming one functional member with another in a unitary fashion. The coupling may occur in any direction, including rotationally.

The order of steps can occur in a variety of sequences unless otherwise specifically limited. The various steps described herein can be combined with other steps, interlineated with the stated steps, and/or split into multiple steps. Similarly, elements have been described functionally and can be embodied as separate components or can be combined into components having multiple functions.

The invention has been described in the context of various exemplary embodiments. Apparent modifications and alterations to the described embodiments are available to those of ordinary skill in the art given the disclosure contained herein. The scope of the invention herein or equivalents thereof is only limited by the scope of the claims in conformity with the patent laws.

What is claimed is:

1. A floating offshore platform, comprising:

a floating hull comprising:

at least three vertically extending columns; and at least one pontoon coupled to at least one of the vertically extending columns, wherein the at least one pontoon is configured to be disposed at least partially below a surface of water in which the offshore platform is disposed;

a topsides coupled to at least one of the columns and spaced vertically above the at least one pontoon; and at least two rigid extension plates each extending substantially horizontally from the at least one pontoon, one of the extension plates being disposed above the other of the extension plates, each extension plate being at an elevation that is below a surface of water in which the offshore platform is disposed during operation, forming an underwater water trap between the extension plates, wherein each extension plate has a first side fixedly coupled to the pontoon and at least one free peripheral side, the free peripheral sides of the adjacent extension plates defining a lateral opening for passage of water from outside the underwater water trap, wherein the extension plates are configured to reduce heave motion on the platform by at least causing horizontal water separation, vertical water separation, or a combination thereof around the pontoon-coupled extension plates as the platform moves in water and wherein the at least two extension plates are non-movable relative to the pontoon.

2. The offshore platform of claim 1, wherein the extension plates are configured to increase a heave period response of the offshore platform to a sea wave having a heave period compared to a heave period response of an offshore platform without the extension plates.

3. The offshore platform of claim 1, wherein the extension plates are coupled inclusively between the bottom of the pontoon and the top of the pontoon.

4. The offshore platform of claim 1, wherein the extension plates comprise at least one extension plate coupled to a bottom portion of the pontoon.

5. The offshore platform of claim 4, wherein the extension plates are coupled outwardly from the pontoon, inwardly from the pontoon, or a combination thereof.

6. The offshore platform of claim 1, wherein the extension plates comprise at least one extension plate coupled to a top portion of the pontoon.

7. The offshore platform of claim 6, wherein the extension plates are coupled outwardly from the pontoon, inwardly from the pontoon, or a combination thereof.

8. The offshore platform of claim 1, further comprising the at least two extension plates are coupled to a bottom portion and a top portion of the pontoon.

9. The offshore platform of claim 8, wherein the extension plates are coupled outwardly from the pontoon, inwardly from the pontoon, or a combination thereof.

10. The offshore platform of claim 1, wherein the extension plates comprise at least one extension plate coupled between at least two of the pontoons.

11. The offshore platform of claim 1, wherein the at least two extension plates comprise at least one extension plate having a surface area extending from the pontoons of at least 10% of a surface area defined by an interior perimeter of the pontoons without the extension plate.

12. The offshore platform of claim 1, wherein the at least one pontoon comprises a first pontoon coupled to the column and a second pontoon coupled to the column, and the at least two extension plates are coupled outwardly from the first pontoon, around the column, and to the second pontoon.

13. The offshore platform of claim 1, wherein the column is larger than the pontoon, and the at least two extension plates are coupled outwardly between the pontoon and the column.

14. The offshore platform of claim 1, wherein the at least one pontoon comprises a first pontoon and a second pontoon, the first pontoon comprising a pontoon extension and the second pontoon being coupled to the first pontoon at a non-zero angle, and wherein the at least two extension plates are coupled between the pontoon extension of the first pontoon and the second pontoon.

* * * * *